US007341520B2

(12) United States Patent
Mattice et al.

(10) Patent No.: US 7,341,520 B2
(45) Date of Patent: Mar. 11, 2008

(54) MOVING THREE-DIMENSIONAL DISPLAY FOR A GAMING MACHINE

(75) Inventors: Harold E. Mattice, Gardnerville, NV (US); Christian E. Gadda, Las Vegas, NV (US)

(73) Assignee: IGT, Reno, NV (US)

( * ) Notice: Subject to any disclaimer, the term of this patent is extended or adjusted under 35 U.S.C. 154(b) by 815 days.

(21) Appl. No.: 10/603,877

(22) Filed: Jun. 25, 2003

(65) Prior Publication Data

US 2004/0266536 A1 Dec. 30, 2004

(51) Int. Cl.
*A63F 9/24* (2006.01)

(52) U.S. Cl. ..... 463/31; 463/20; 463/22; 463/32; 463/33; 463/34

(58) Field of Classification Search ..... None
See application file for complete search history.

(56) References Cited

U.S. PATENT DOCUMENTS 5,580,055 A * 12/1996 Hagiwara ..... 273/143 R
5,669,685 A * 9/1997 Kotani et al. ..... 353/28
6,033,307 A * 3/2000 Vancura ..... 463/20
6,517,433 B2 * 2/2003 Loose et al. ..... 463/20
6,517,437 B1 * 2/2003 Wells et al. ..... 463/30
6,638,165 B2 * 10/2003 Uchiyama et al. ..... 463/20
6,817,946 B2 * 11/2004 Motegi et al. ..... 463/31
6,887,157 B2 * 5/2005 LeMay et al. ..... 463/32
7,121,945 B2 * 10/2006 Suganuma et al. ..... 463/34
7,160,187 B2 * 1/2007 Loose et al. ..... 463/20
2004/0102244 A1 * 5/2004 Kryuchkov et al. ..... 463/32

FOREIGN PATENT DOCUMENTS

JP 2001259172 A * 9/2001

* cited by examiner

*Primary Examiner*—Robert Pezzuto
*Assistant Examiner*—Sunit Pandya
(74) *Attorney, Agent, or Firm*—Beyer Weaver LLP

(57) ABSTRACT

A gaming apparatus may include a primary display unit, a value input device, a first controller coupled to the primary display unit and the value input device, a microprocessor and associated memory, and a second display unit. The secondary display unit may include a viewing window, a first object coupled to a movable member, and a second object. The secondary display unit may also include a semitransparent mirror positioned to reflect an image of either of the first or second objects and to transmit an image of the other object, such that both objects are viewable through the viewing window. The secondary display unit may additionally include a motor coupled to the movable member to move the first object such that a depth of the image of the first object changes relative to a depth of the image of the second object as viewed through the viewing window.

26 Claims, 20 Drawing Sheets

MOVING THREE-DIMENSIONAL DISPLAY FOR A GAMING MACHINE

BACKGROUND

The present disclosure is related to presenting games on gaming machines such as reel-type slot machines, video poker machines, etc.

Various presentation techniques for gaming machines have been previously described. For example, contemporary mechanical reel-type slot machines include three-dimensional spinning reels that can be viewed by a player. Also, contemporary video gaming machines (e.g., video reel-type slots, video poker, video blackjack, video keno, video bingo, etc.) include display devices that generate two-dimensional images such as visual representations of spinning reels, cards, symbols, characters, etc. that appear in primary games, secondary games, help screens, attract modes, etc.

Additionally, some video gaming machines generate two-dimensional images that appear to be three-dimensional. These video gaming machines may employ shading, highlighting, and perspective techniques to cause a person to perceive depth in a two-dimensional image.

Some gaming machines have employed beam splitters and/or mirrors to generate three-dimensional representations. U.S. Pat. No. 5,669,685 to Kotani et al. describes a game machine in which an image of eyes and a mouth generated by a cathode ray tube is superimposed on an image of a three-dimensional object in the shape of a human face. The image of the human face is reflected off a large semitransparent mirror such that it can be viewed by a player. The image of the eyes and mouth are projected onto a large screen behind the semitransparent mirror. The image of the eyes and mouth on the screen may be seen by the player through the semitransparent mirror such that the eyes and mouth appear superimposed on the image of the human face as seen by the player. A projector housing includes the screen and a cathode ray tube that projects the image of the eyes and mouth onto the screen. The projector housing can be moved such that the eyes and mouth appear to be behind or in front of the image of the human face as seen by the player.

SUMMARY

In one embodiment, a gaming apparatus is provided. The gaming apparatus may comprise a primary display unit, and a value input device. The gaming apparatus may also comprise a first controller operatively coupled to the primary display unit and the value input device. The first controller may include a first microprocessor and a first memory operatively coupled to the first microprocessor. The first controller may be configured to receive wager data from the value input device, the wager data indicative of a wager submitted by a player. The first controller may also be configured to cause the primary display unit to display an outcome of a game, and to determine a value payout associated with the outcome of the game. The gaming apparatus may further comprise a secondary display unit separate from the primary display unit. The secondary display unit may include a viewing window, a first object coupled to a movable member, and a second object. The secondary display unit may also include a semitransparent mirror positioned posterior to the viewing window to reflect an image of one of the first object and the second object and to transmit an image of the other of the first object and the second object, wherein the image of the first object and the image of the second object are viewable through the viewing window. The secondary display unit may additionally include a first motor coupled to the movable member to move the first object such that a depth of the image of the first object changes relative to a depth of the image of the second object as viewed through the viewing window.

In another embodiment, a gaming method is provided. The gaming method may include receiving a wager from a player via a value input device, and displaying an outcome of a game via a primary display unit. The gaming method may additionally include determining a value payout associated with the outcome of the game. The gaming method may also include displaying an image of a first object and an image of a second object via a secondary display unit, the secondary display unit having a viewing window, wherein the image of the first object and the image of the second object appear superimposed as viewed from the viewing window. The gaming method may further include determining a bonus condition of the game, and in response to the bonus condition, causing the first object to repeatedly move during a period of time, wherein a depth of the image of the first object relative to a depth of the image of the second object changes as viewed from the viewing window during the period of time. The gaming method may still further include, after the period of time, causing the first object to stop at a first ending position.

In yet another embodiment, a gaming apparatus is provided. The gaming apparatus may comprise a primary display unit, and a value input device. The gaming apparatus may also comprise a first controller operatively coupled to the primary display unit and the value input device. The first controller may include a first microprocessor and a first memory operatively coupled to the first microprocessor. The first controller may be configured to receive wager data from the value input device, the wager data indicative of a wager submitted by a player. The first controller may additionally be configured to cause the primary display unit to display an outcome of a game, and to determine if the game is in bonus. The first controller being may also be configured to transmit bonus information to a second controller if the game is in bonus, and to determine a value payout associated with the outcome of the game. The gaming apparatus may further comprise a secondary display unit separate from the primary display unit. The secondary display unit may include a viewing window, and a first object coupled to a movable member, the first object including a numeric display, the numeric display capable of displaying at least numbers, wherein numbers displayed by the numeric display are viewable through the viewing window. The secondary display unit may additionally include a second object, and a semitransparent mirror positioned posterior to the viewing window to reflect an image of one of the first object and the second object and to transmit an image of the other of the first object and the second object, wherein the image of the first object and the image of the second object are viewable through the viewing window. The secondary display unit may further include a first motor coupled to the movable member to move the first object such that a depth of the image of the first object changes relative to a depth of the image of the second object as viewed through the viewing window. The secondary unit may still further include a second controller separate from the first controller, the second controller operatively coupled to the first motor and to the numeric display. The second controller may be configured to, in response to the bonus information received from the first controller, cause the first motor to repeatedly move the first object during a time period such that the depth of the image of the first object changes relative to the depth of the image of the second object. The second controller may be additionally configured to, in response to the bonus information received from the first controller, cause the numeric display to display changing numbers during the time period. The second controller may be further configured to cause the first motor to stop the first object at an ending position after the time period, and to cause the numeric display to display an ending number after the time period.

Additional aspects of the invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
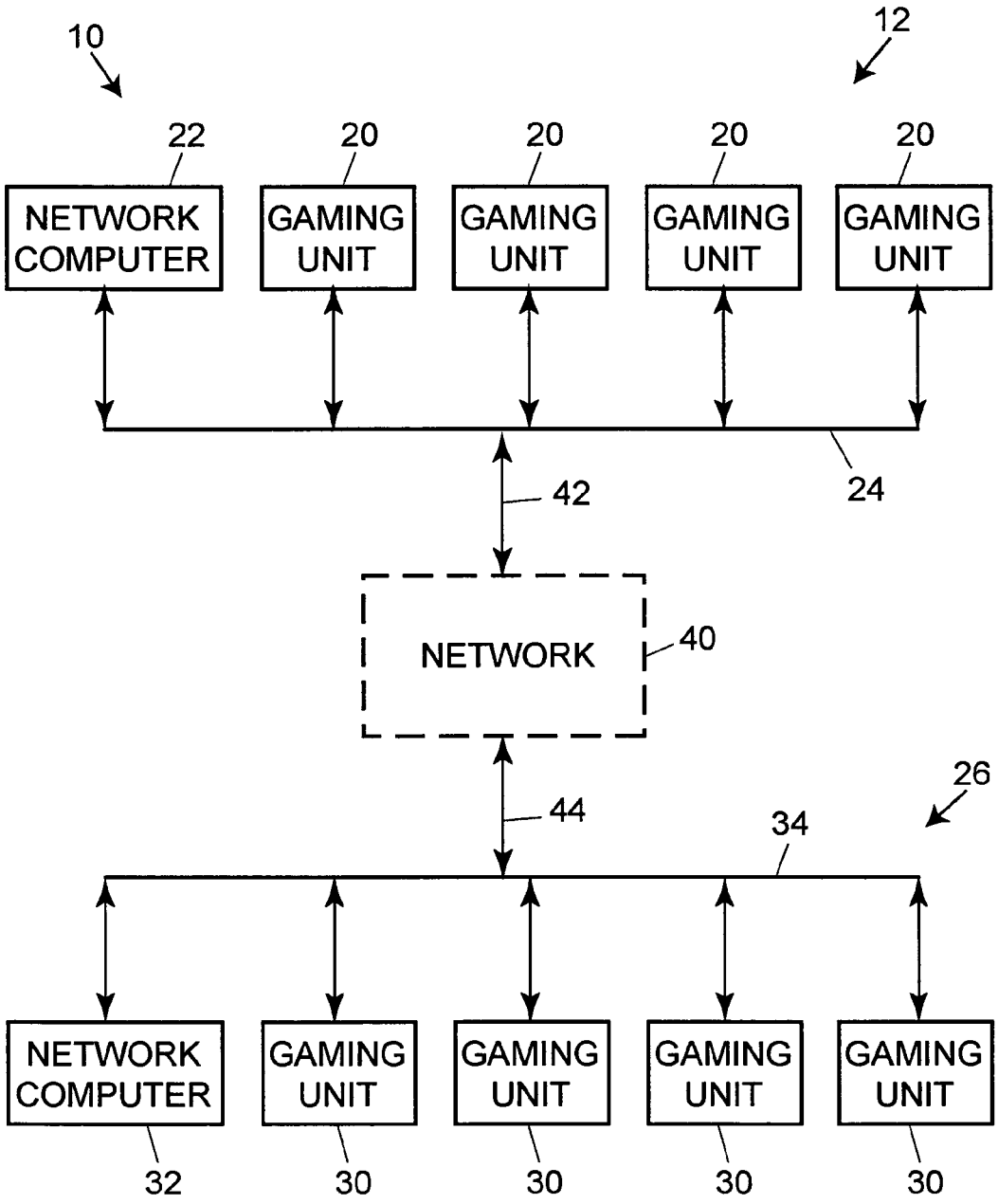
FIG. 1 is a block diagram of an embodiment of a gaming system.

FIG. 1 illustrates one possible embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
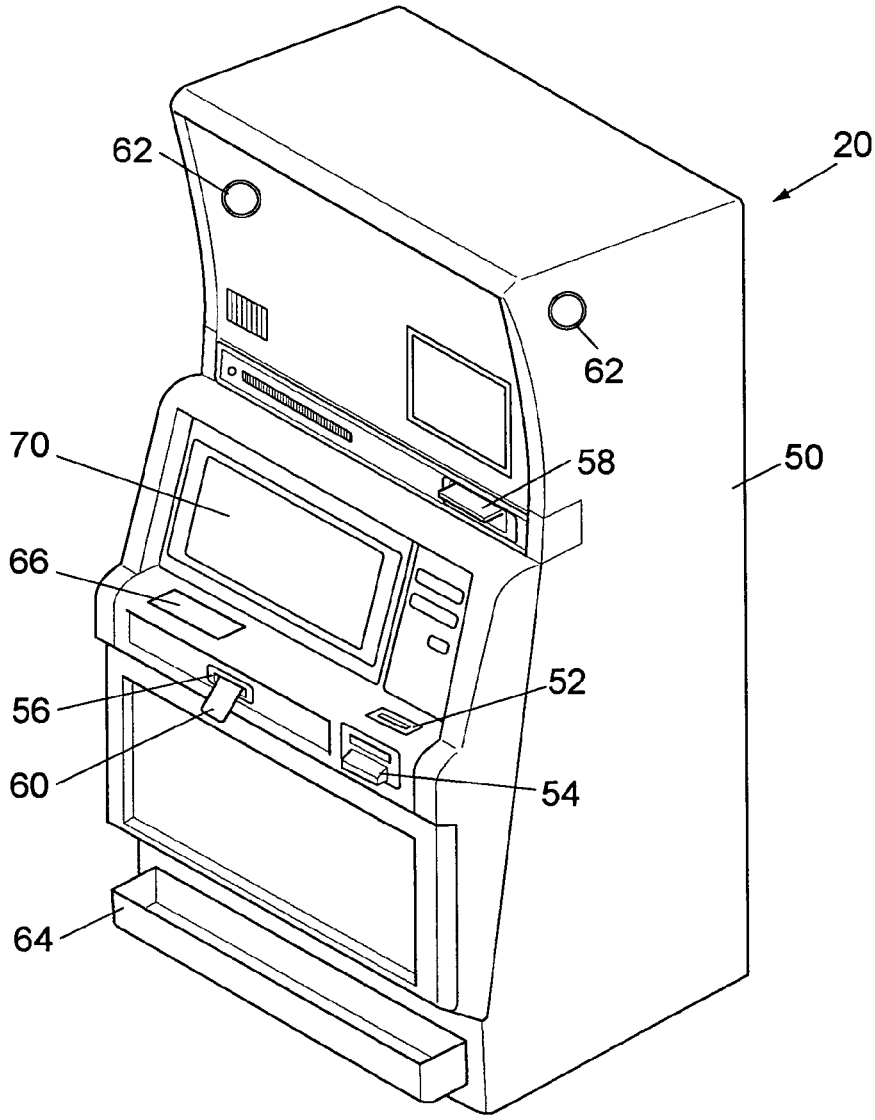
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader and/or writer 58 (hereinafter "card reader/writer 58"), which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader/writer 58 may include any type of card reading device, such as a magnetic card reader or an optical card reader, and may be used to read data from a card offered by a player, such as a credit card or a player tracking card. The card reader/writer 58 may also include any type of card writing device, such as a magnetic card writer or an optical card writer, and may be used to write data to a card offered by a player, such as a credit card or a player tracking card. If provided for player tracking purposes, the card reader/writer 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66 and a display unit 70 for displaying display data relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc. The display unit 70 may include one or more two dimensional display units such as a color video display unit displaying images. Additionally, the display unit 70 may include one or more three dimensional display units such as mechanical reels, a holographic display, a stereoscopic display, a three dimensional display volume, etc.

Figure 2A:
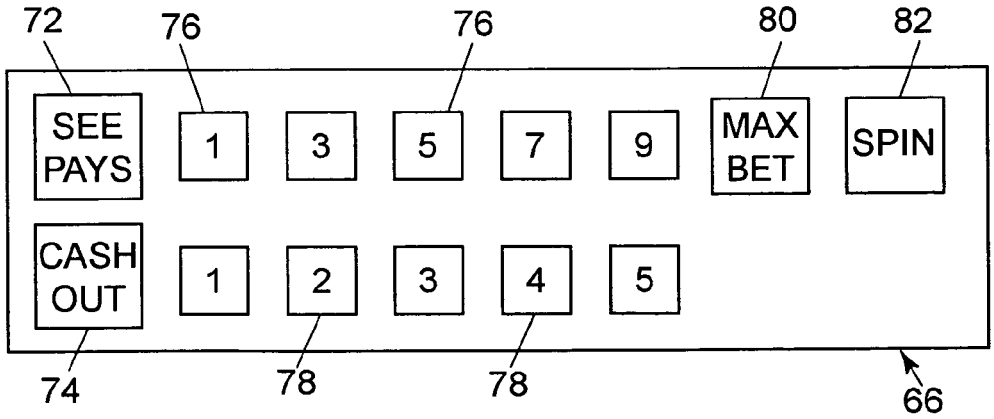
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Figure 2B:
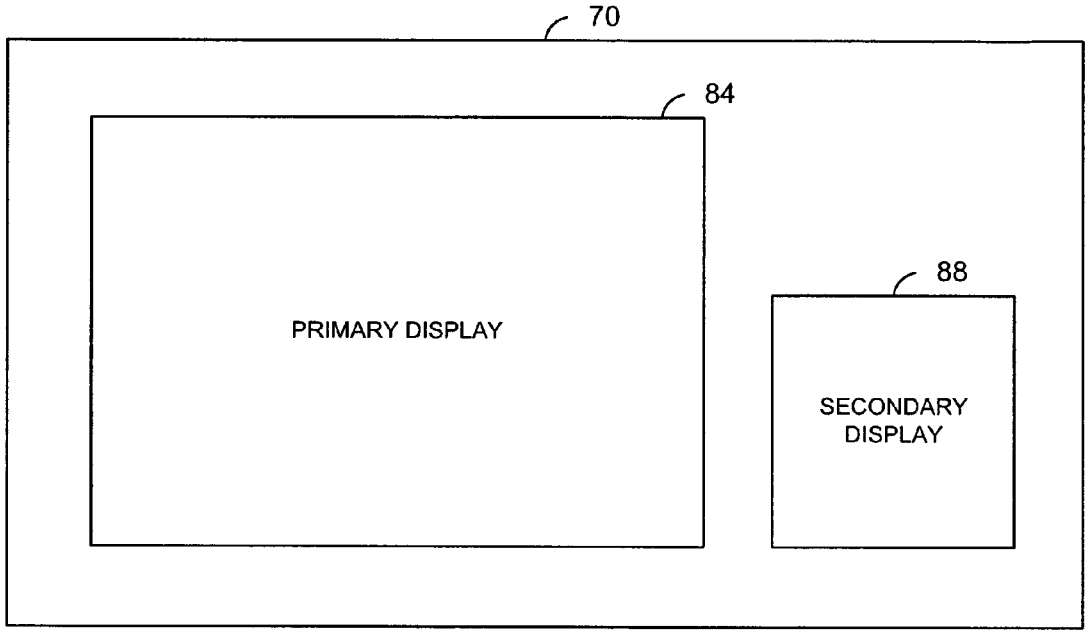
FIG. 2B illustrates an embodiment of a display unit for a gaming unit.

FIG. 2B illustrates one possible embodiment of the display unit 70. The display unit may include a primary display unit 84 and a secondary display unit 88. The primary display unit 84 may include an image generation device such as a cathode ray tube (CRT), a liquid crystal display (LCD), a plasma display, etc. The primary display unit 84 may also include a mechanical display such as mechanical reels, a spinning wheel, etc. The secondary display unit 88 may be capable of generating three-dimensional effects, as will be described in more detail subsequently.

In operation, a primary game (or images of the primary game) may be displayed to the player via the primary display unit 84. For example, if the gaming unit is a reel-type slot machine, the primary display unit 84 may include mechanical reels. As another example, if the primary display unit 84 is a CRT, LCD, or the like, the primary display unit 84 may display images of spinning reels, cards, a bingo card, etc. Information secondary to the primary game may be displayed to the player via the secondary display unit 88. For example, bonus related information may be displayed to the player via the secondary display unit 88.

The display unit 70 may also include tertiary displays units (not shown) for displaying other information to a player such winnings, credits, a number of coins played, etc. It is to be understood, however, that such information need not be displayed via tertiary display units separate from the primary display unit 84 and the secondary display unit 88. Rather, such information may alternatively be displayed to the player via the primary display unit 84 and/or the secondary display unit 88.

Gaming Unit Electronics

Figure 3:
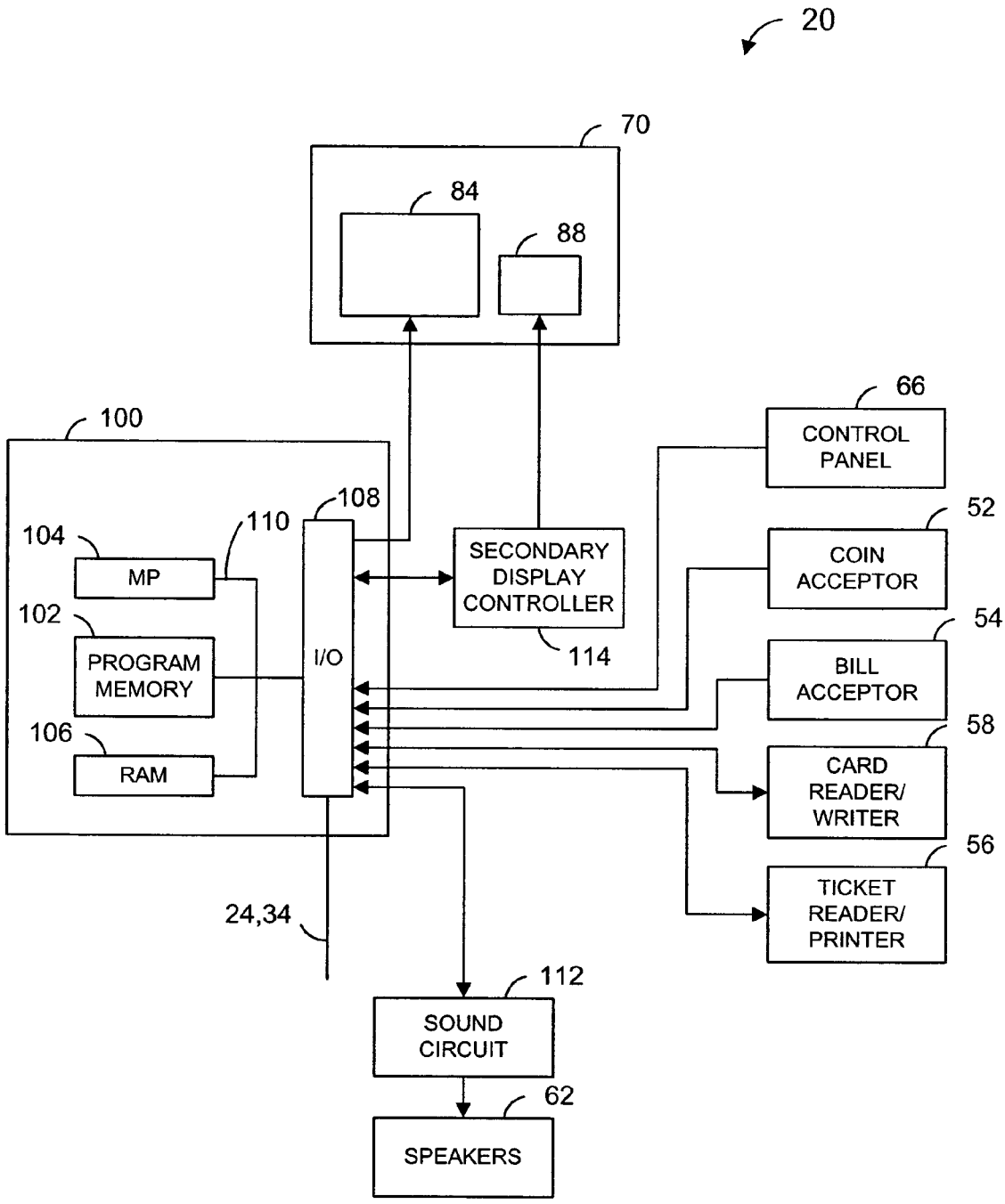
FIG. 3 is a block diagram of the electronic components of a gaming unit of FIG. 2.

FIG. 3 is a block diagram of a number of components that may be incorporated in the gaming unit 20. Referring to FIG. 3, the gaming unit 20 may include a main controller 100 that may comprise a program memory 102, a microcontroller or microprocessor (MP) 104, a random-access memory (RAM) 106, and an input/output (I/O) circuit 108, all of which may be interconnected via an address/data bus 110. It should be appreciated that although only one microprocessor 104 is shown, the main controller 100 may include multiple microprocessors 104. Similarly, the memory of the main controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memory (or memories) 102 may be implemented as semiconductor memories, magnetically readable memories, and/or optically readable memories, for example.

The program memory 102 may comprise a read-only memory (ROM), a read/write or alterable memory, such as a hard disk, a flash memory, an erasable programmable read-only memory (EPROM), an electrically erasable programmable read-only memory (EEPROM), etc. In the event a hard disk is used as a program memory, the address/data bus 110 shown schematically in FIG. 3 may comprise multiple address/data buses, which may be of different types, and there may be an I/O circuit disposed between the address/data buses.

The gaming unit 20 may also include a secondary display controller 114 operatively coupled to the main controller 100 and the secondary display unit 88. The secondary display controller 114 may comprise a program memory, a microcontroller or microprocessor, a RAM, and an I/O circuit (all not shown), which may be of similar types as described above with reference to the main controller 100. The secondary display controller 114 may be operatively coupled to the main controller 100 via the I/O circuit 108.

FIG. 3 illustrates that the control panel 66, the coin acceptor 52, the bill acceptor 54, the card reader 58, the ticket reader/printer 56 and the display unit 70 may be operatively coupled to the I/O circuit 108, each of those components being so coupled by either a unidirectional or bidirectional, single-line or multiple-line data link, which may depend on the design of the component that is used. The links may each comprise a serial communication link and/or a parallel communication link. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 70, and 112 may be connected to the I/O circuit 108 via one or more respective direct lines or conductors. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

In one embodiment, the secondary display controller 114 may be operatively coupled to the microprocessor 104 via a plurality of communication links. For example, a first communication link may be used for sending and/or receiving control information to/from the secondary display controller 114, while a second communication link may be used for downloading software to the secondary display controller 114. In other embodiments, may be operatively coupled to the microprocessor 104 via one communication links.

Although the main controller 100 and the secondary display controller 114 are shown as separate devices in FIG. 3, it should be noted that such a representation is merely exemplary and that the functionality of both devices could be incorporated into a single device. For example, the microprocessor 104 could perform some or all of the operations carried out by the secondary display controller 114.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the main controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memory or memories 102, 106 of the main controller 100 and the memory or memories of the secondary display controller 114 are physically and/or structurally configured in accordance with computer program instructions.

Figure 4:
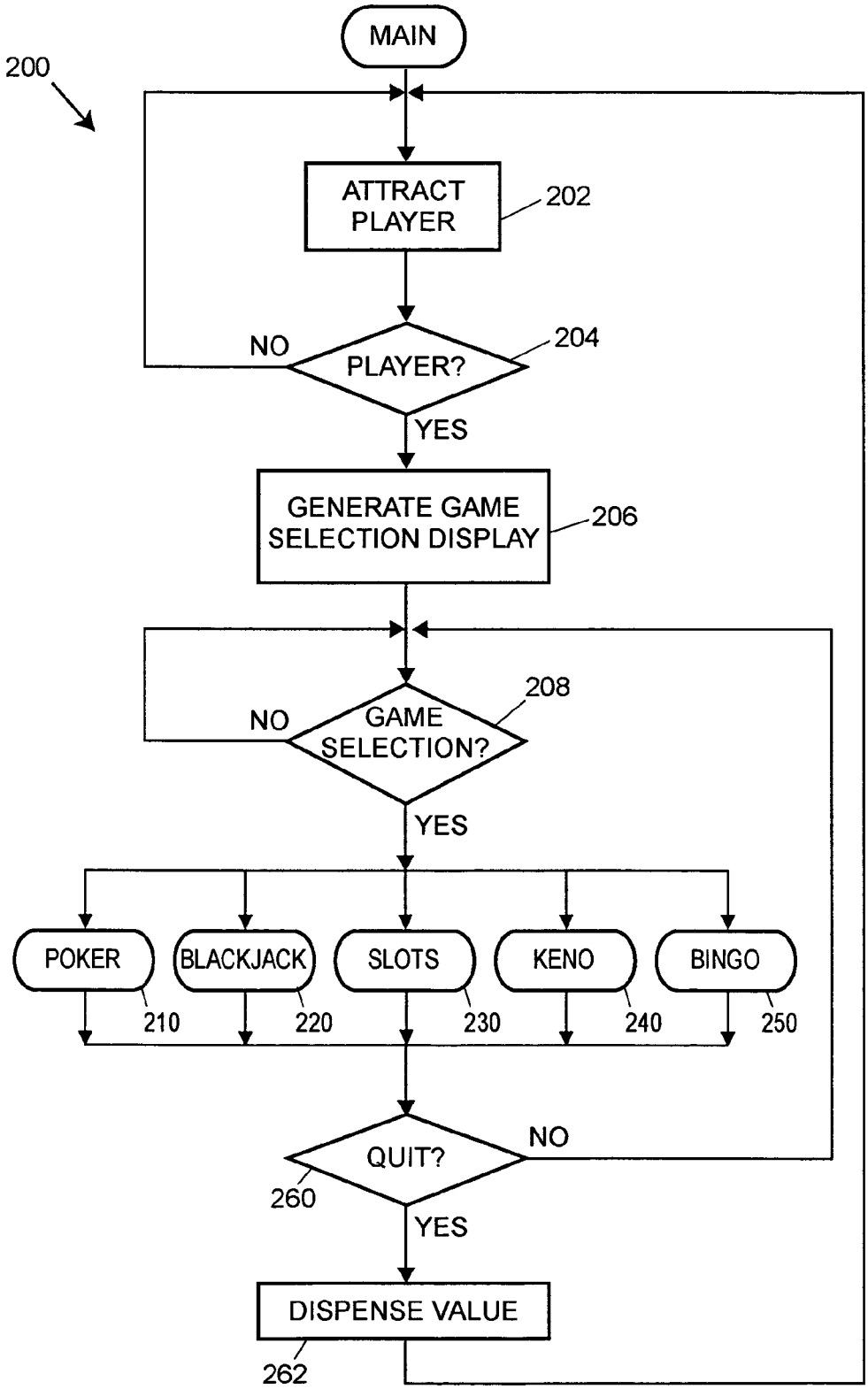
FIG. 4 is a flowchart of an embodiment of a main routine that may be performed during operation of one or more of the gaming units.

FIG. 4 is a flowchart of a main operating routine 200 that may be stored in the memory of the main controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the primary display unit 84 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the primary display unit 84 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the main controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the main controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
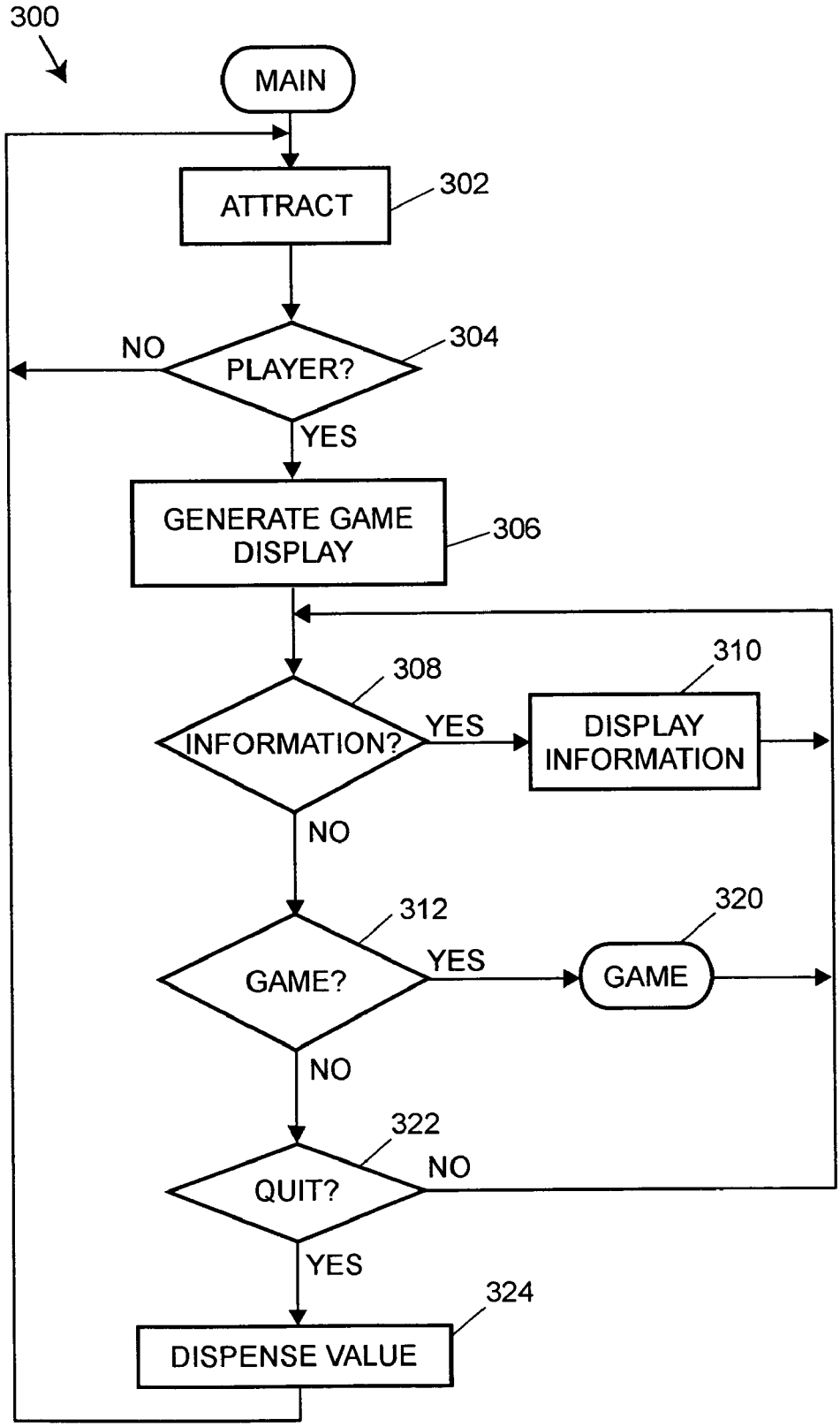
FIG. 5 is a flowchart of an alternative embodiment of a main routine that may be performed during operation of one or more of the gaming units.

FIG. 5 is a flowchart of an alternative main operating routine 300 that may be stored in the memory of the main controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may include displaying images via the primary display unit 84 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the primary display unit 84 at block 306. The game display generated at block 306 may include, for example, an image of the casino game that may be played on the gaming unit 20 and/or a visual message to prompt the player to deposit value into the gaming unit 20. In gaming machines that include a mechanical display (e.g., mechanical reels), block 306 may be omitted. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the main controller 100 may dispense value to the player at block 324 based on the outcome of the game(s) played by the player. The operation may then return to block 302. If the player did not wish to quit as determined at block 322, the operation may return to block 308.

Video Poker

Figure 6:
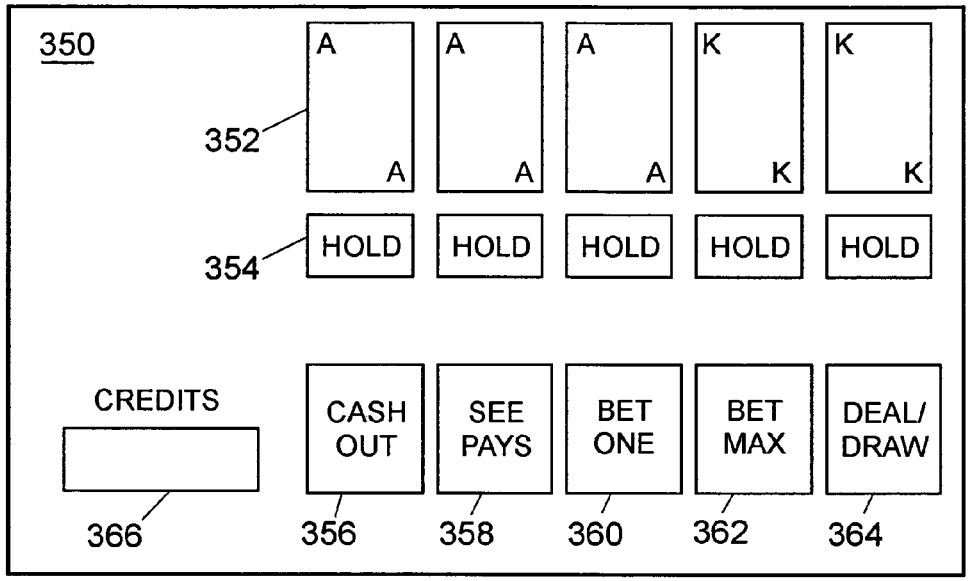
FIG. 6 is an illustration of an embodiment of a visual display that may be displayed during performance of the video poker routine of FIG. 8.

FIG. 6 is an exemplary display 350 that may be shown on the primary display unit 84 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
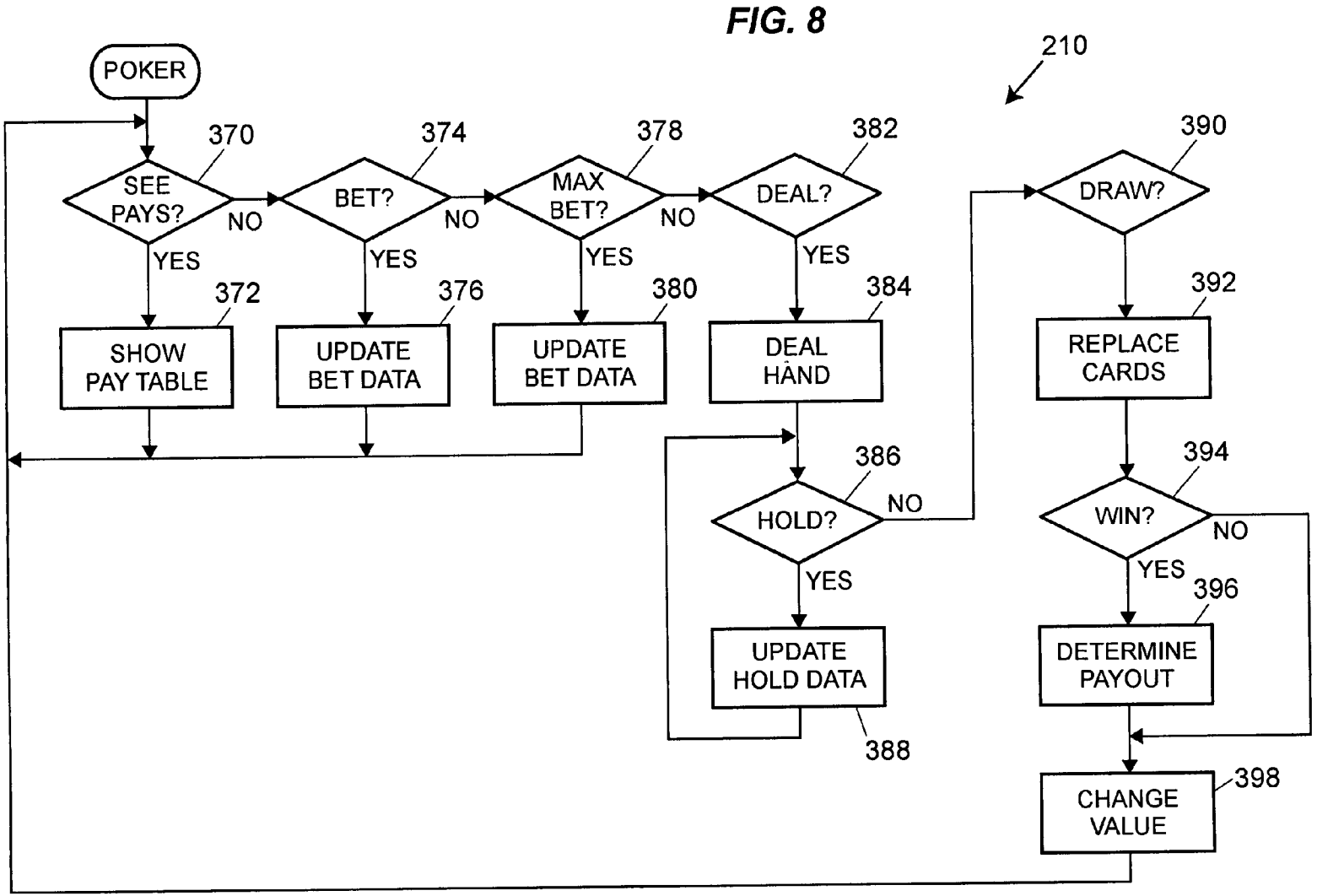
FIG. 8 is a flowchart of an embodiment of a video poker routine that may be performed by one or more of the gaming units.

FIG. 8 is a flowchart of the video poker routine 210 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the primary display unit 84. At block 374, the routine may determine whether the player has made a bet, such as by pressing the "Bet One Credit" button 360, in which case at block 376 bet data corresponding to the bet made by the player may be stored in the memory of the main controller 100. At block 378, the routine may determine whether the player has pressed the "Bet Max Credits" button 362, in which case at block 380 bet data corresponding to the maximum allowable bet may be stored in the memory of the main controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the primary display unit 84 to generate the playing card images 352. After the hand is dealt, at block 386 the routine may determine if any of the "Hold" buttons 354 have been activated by the player, in which case data regarding which of the playing card images 352 are to be "held" may be stored in the main controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the main controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
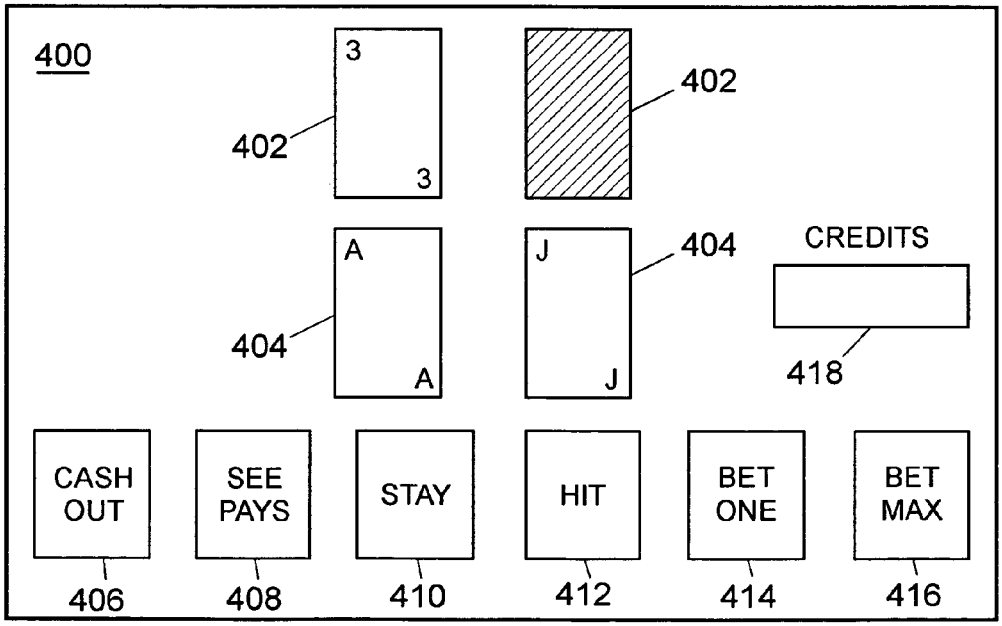
FIG. 7 is an illustration of an embodiment of a visual display that may be displayed during performance of the video blackjack routine of FIG. 9.

FIG. 7 is an exemplary display 400 that may be shown on the primary display unit 84 during performance of the video blackjack routine 220 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
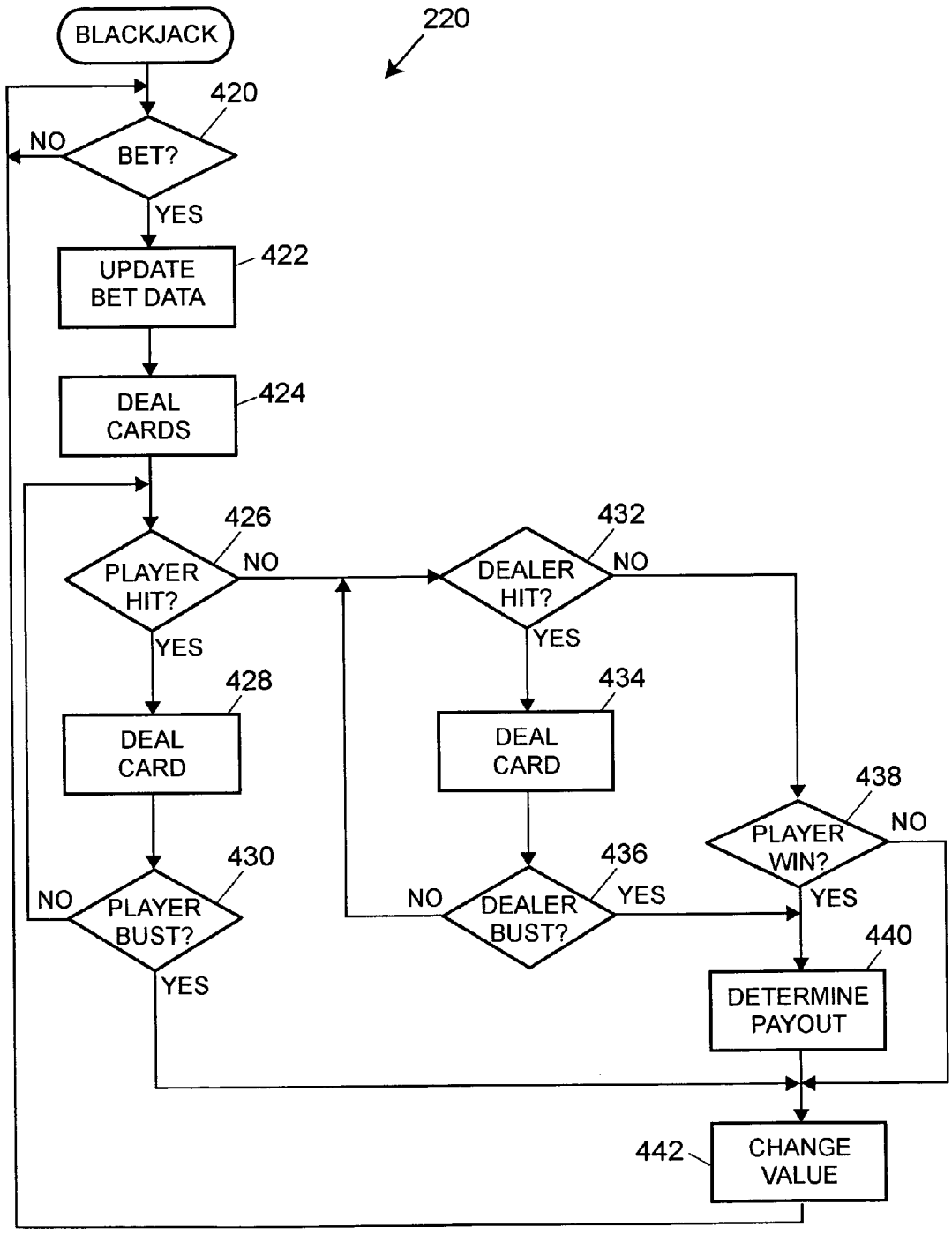
FIG. 9 is a flowchart of an embodiment of a video blackjack routine that may be performed by one or more of the gaming units.

FIG. 9 is a flowchart of the video blackjack routine 220 shown schematically in FIG. 4. Referring to FIG. 9, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the main controller 100. At block 424, a dealer's hand and a player's hand may be "dealt" by making the playing card images 402, 404 appear on the primary display unit 84.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 7).

Video Slots

Figure 10:
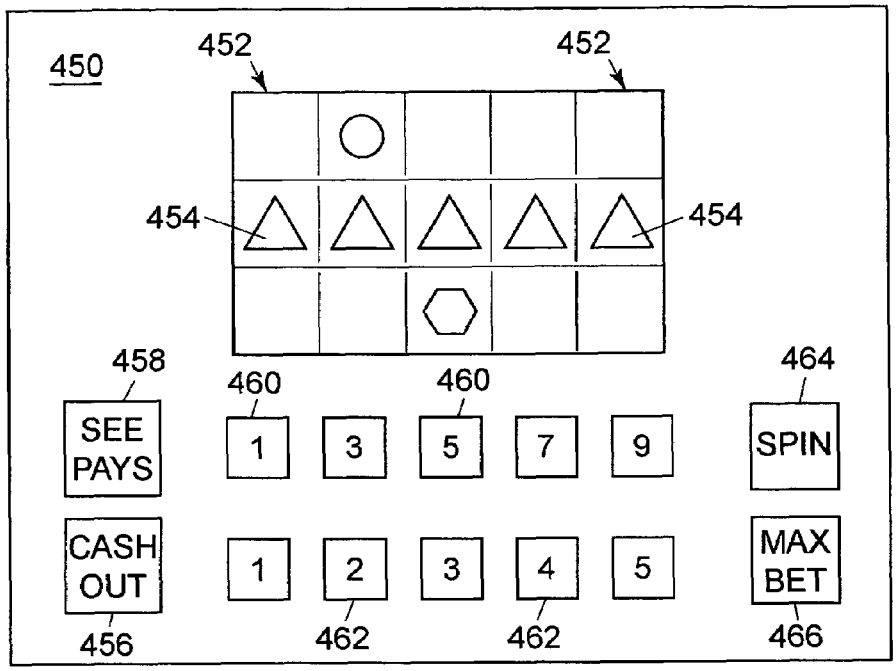
FIG. 10 is an illustration of an embodiment of a visual display that may be displayed during performance of the slots routine of FIG. 12.

FIG. 10 is an exemplary display 450 that may be shown on the primary display unit 84 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized. For example, U.S. Pat. No. 6,413,162 to Baerlocher et al. describes a gaming device having unisymbol display reels. Each symbol on a display of the gaming device represents, or is included on, a different reel. In one specific example, U.S. Pat. No. 6,413,162 describes displaying eighteen independent unisymbol reels, each capable of randomly generating and displaying one of a plurality of symbols. In another example, U.S. Pat. No. 6,413,162 describes unisymbol reels displayed in concentric circles.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
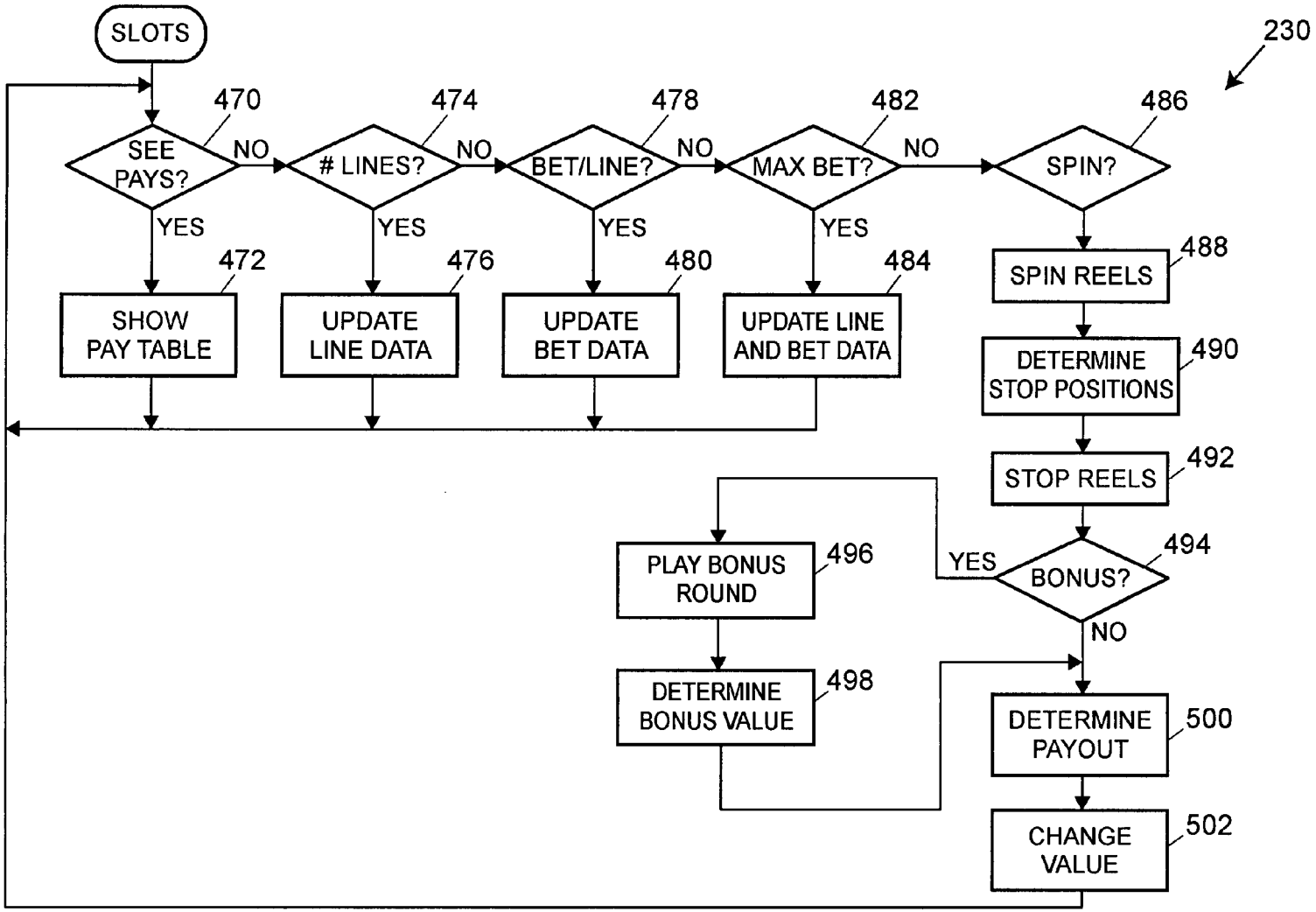
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the primary display unit 84. At block 474, the routine may determine whether the player has pressed one of the payline-selection buttons 460, in which case at block 476 data corresponding to the number of paylines selected by the player may be stored in the memory of the main controller 100. At block 478, the routine may determine whether the player has pressed one of the bet-selection buttons 462, in which case at block 480 data corresponding to the amount bet per payline may be stored in the memory of the main controller 100. At block 482, the routine may determine whether the player has pressed the "Max Bet" button 466, in which case at block 484 bet data (which may include both payline data and bet-per-payline data) corresponding to the maximum allowable bet may be stored in the memory of the main controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine 230 may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the primary display unit 84, actual slot machine reels that are capable of being spun may be utilized instead.

Video Keno

Figure 11:
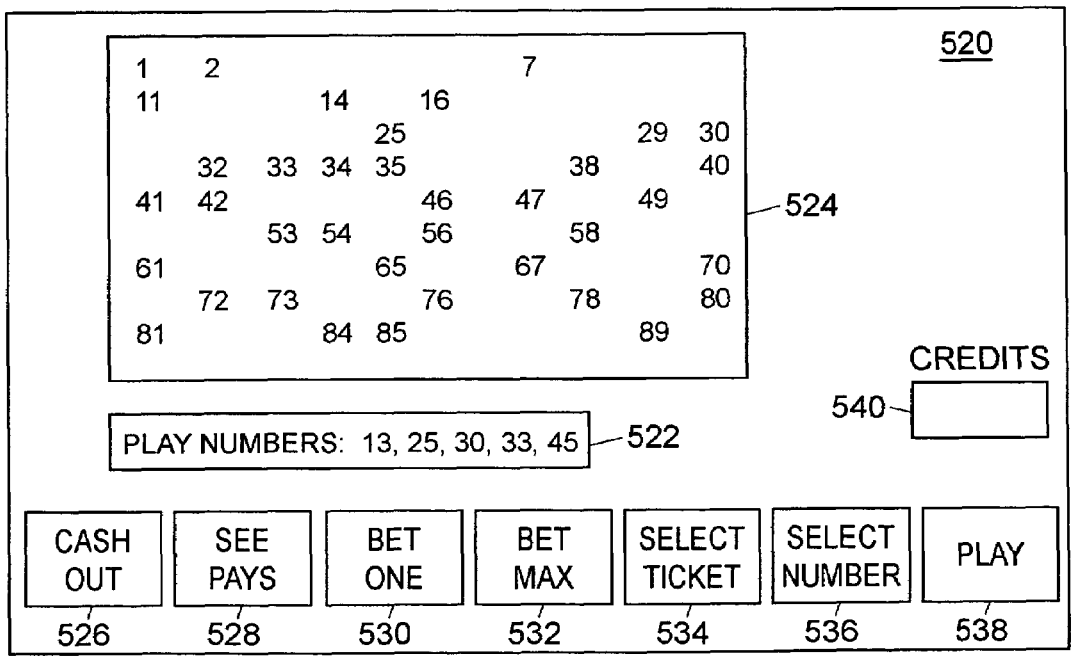
FIG. 11 is an illustration of an embodiment of a visual display that may be displayed during performance of the video keno routine of FIG. 13.

FIG. 11 is an exemplary display 520 that may be shown on the primary display unit 84 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
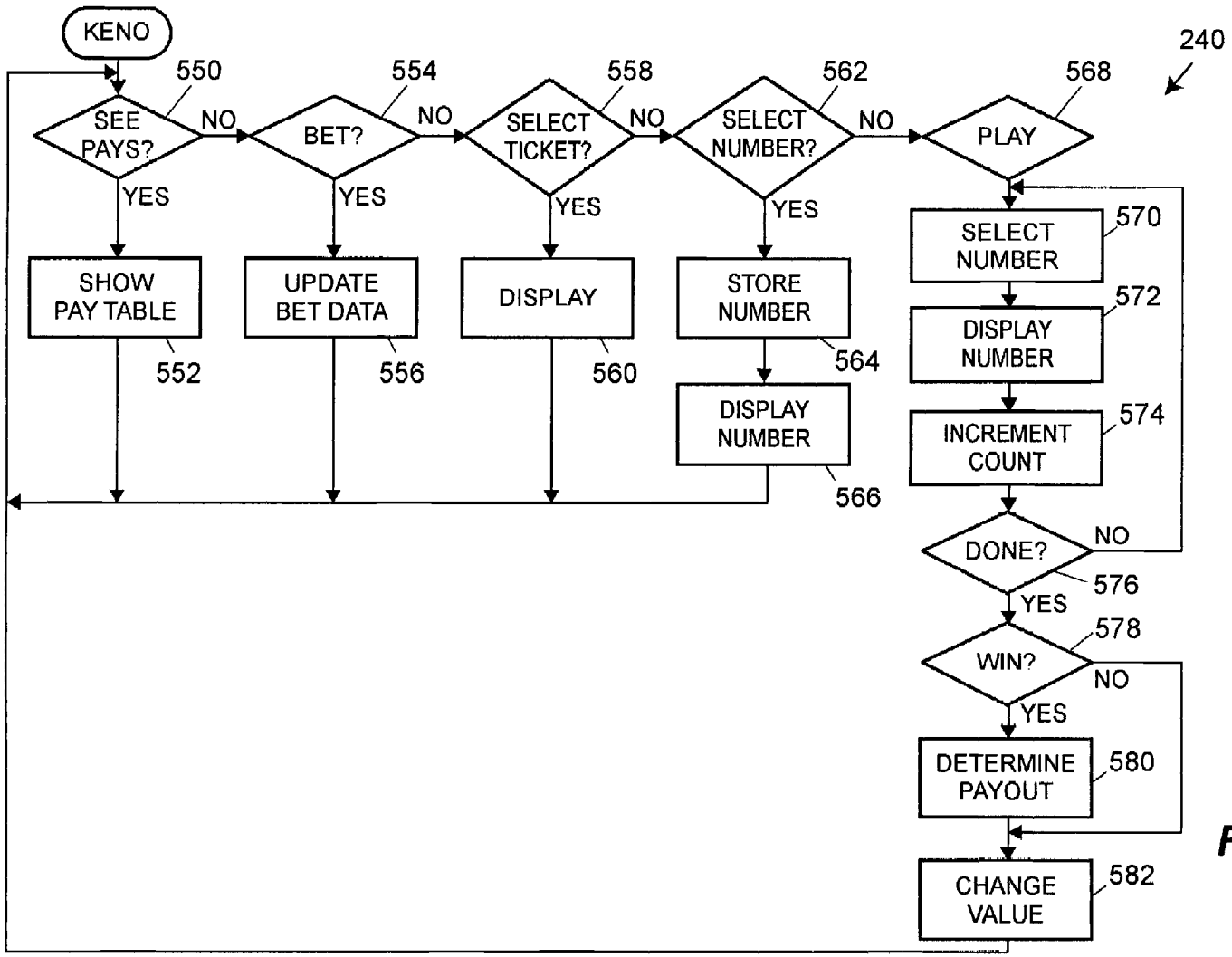
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the main controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the primary display unit 84. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the main controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the main controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the main controller 100 or a central computer operatively connected to the controller, such as one of the network computers 22, 32. At block 572, the randomly selected game number may be displayed on the primary display unit 84 and the display units 70 of other gaming units 20 (if any) which are involved in the same keno game. At block 574, the main controller 100 (or the central computer noted above) may increment a count which keeps track of how many game numbers have been selected at block 570.

At block 576, the main controller 100 (or one of the network computers 22, 32) may determine whether a maximum number of game numbers within the range have been randomly selected. If not, another game number may be randomly selected at block 570. If the maximum number of game numbers has been selected, at block 578 the main controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
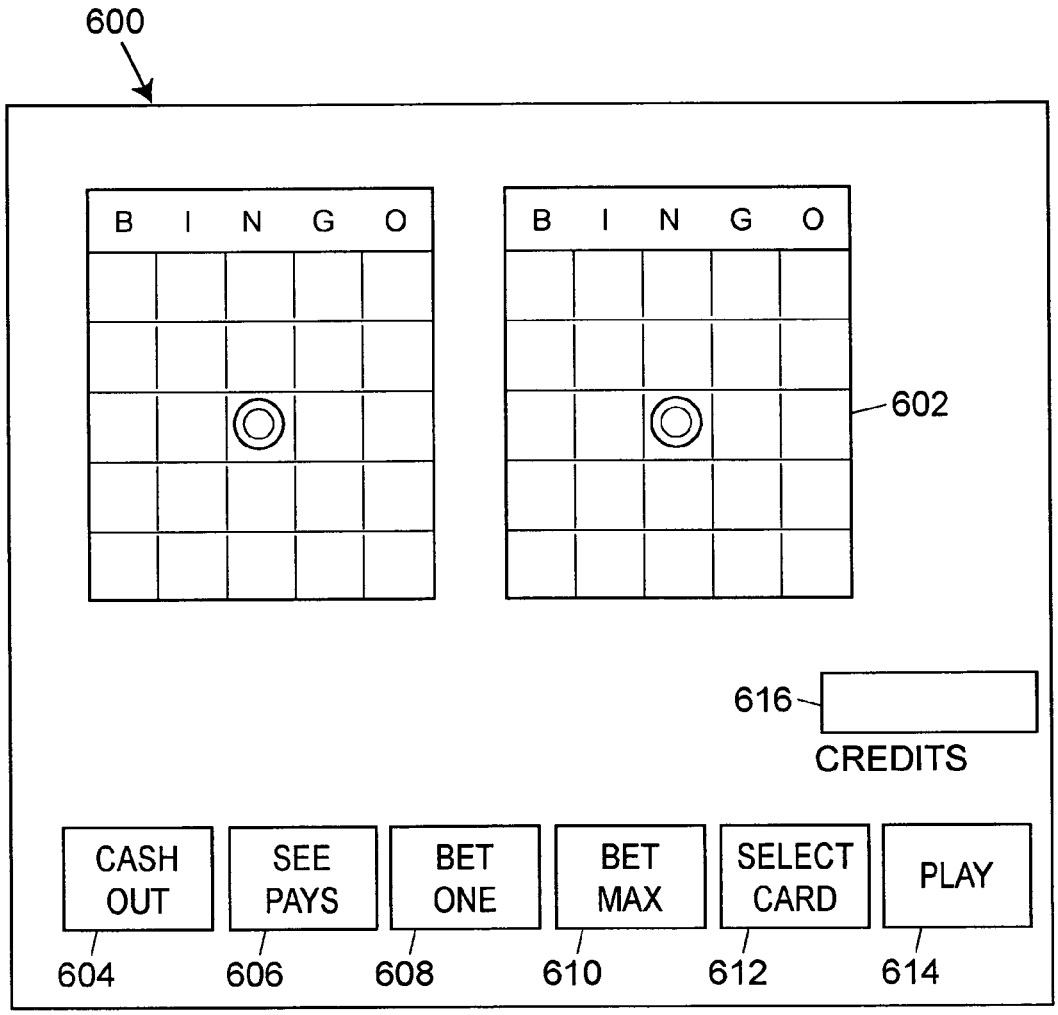
FIG. 14 is an illustration of an embodiment of a visual display that may be displayed during performance of the video bingo routine of FIG. 15.

FIG. 14 is an exemplary display 600 that may be shown on the primary display unit 84 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 15:
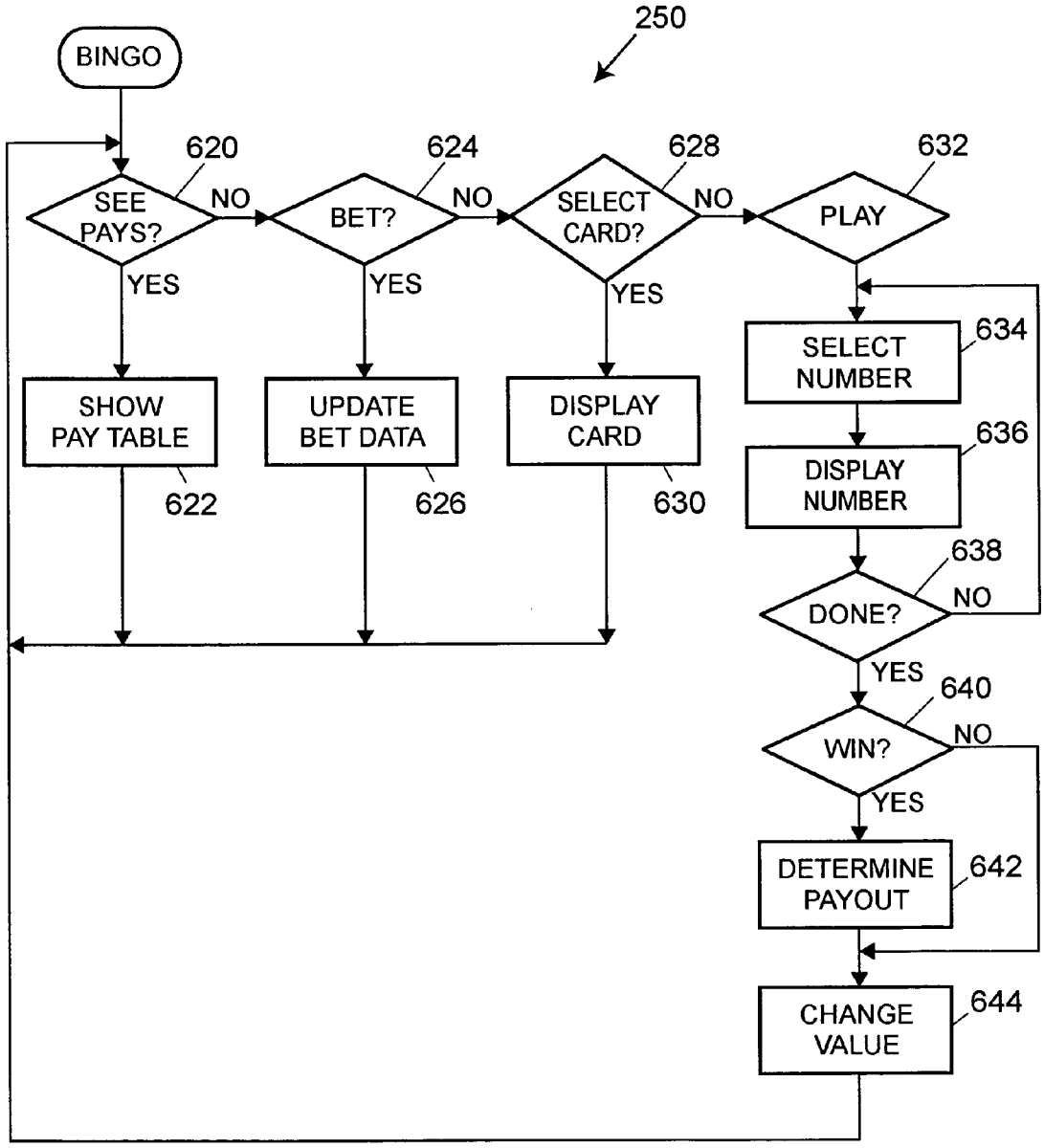
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the main controller 100 in each gaming unit 20 or by one of the network computers 22, 32 to which multiple gaming units 20 are operatively connected.

Referring to FIG. 15, at block 620, the routine may determine whether the player has requested payout information, such as by activating the "See Pays" button 606, in which case at block 622 the routine may cause one or more pay tables to be displayed on the primary display unit 84. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the main controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the main controller 100 or a central computer such as one of the network computers 22, 32. At block 636, the bingo number may be displayed on the primary display unit 84 and the display units 70 of any other gaming units 20 involved in the bingo game.

At block 638, the main controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

Secondary Display Unit

Figure 16:
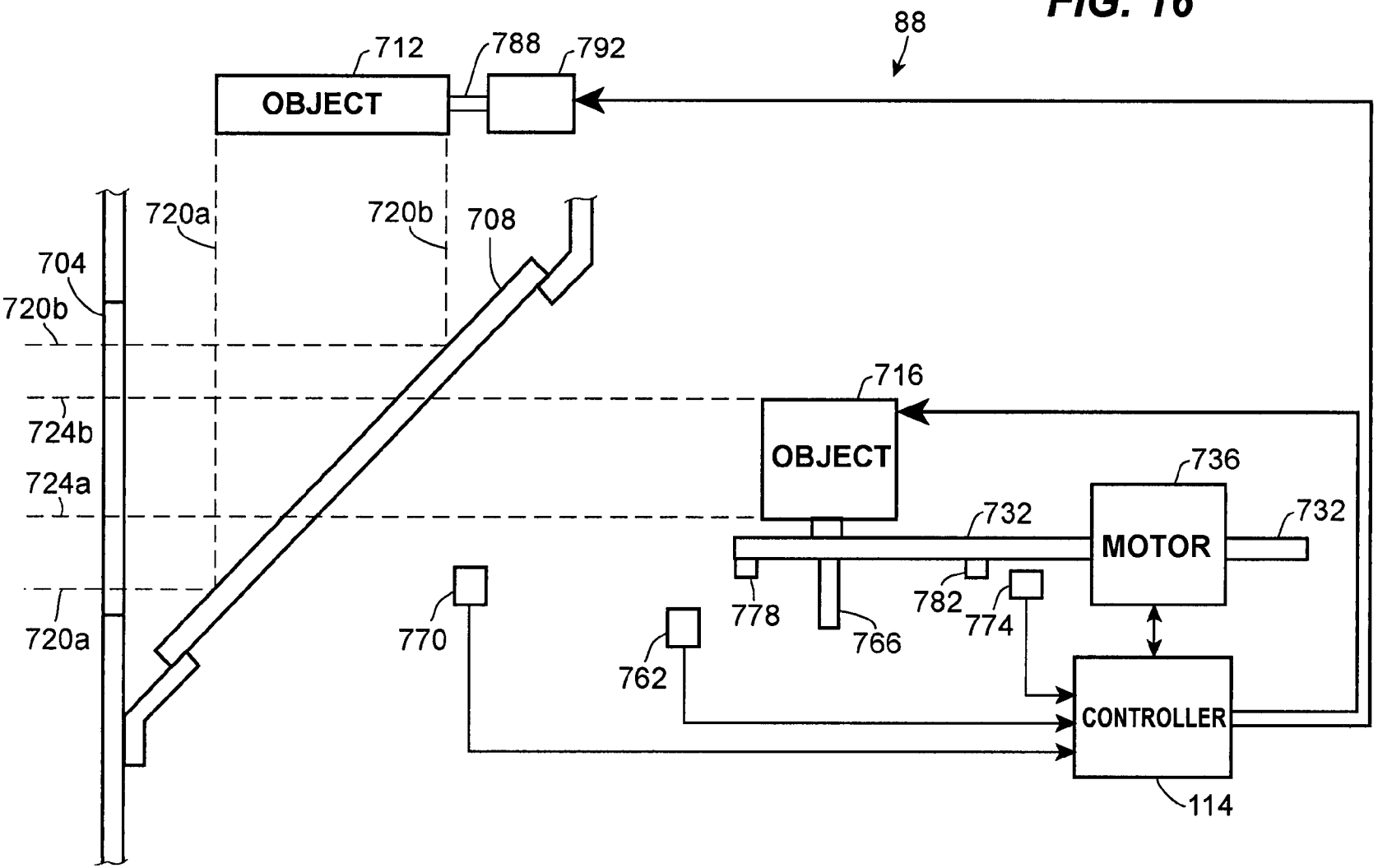
FIG. 16 is a block diagram of one embodiment of a secondary display unit of a gaming unit.

FIG. 16 illustrates a side view of one embodiment of the secondary display unit 88 shown schematically in FIGS. 2B and 3. The secondary display unit 88 may include a viewing window 704, a mirror 708, and objects 712 and 716. The mirror 708 may comprise a mirror that partly transmits and partly reflects light (e.g., transmits approximately 50% and reflects approximately 50%). For example, the mirror 708 may comprise a 50%—silvered mirror or the like. The mirror 708 may be positioned such that an image of the first object 712 and an image of the second object 716 are visible through the viewing window 704. For example, in the embodiment illustrated in FIG. 16, a reflection of the object 712 (reflected by the mirror 708) is visible through the viewing window 704 as indicated by lines 720*a* and 720*b*. Additionally, the object 716 is visible through the viewing window 704 and through the mirror 708 as indicated by lines 724*a*and 724*b*. In the embodiment illustrated in FIG. 16, the mirror 708 is positioned at approximately a 45 degree angle with the viewing window 704 as viewed from the side. In one embodiment, an image of the object 712 is transposed on an image of the object 716 as viewed through the viewing window 704.

The object 716 may be coupled to a movable member 732 which may be moved by a motor 736. In one embodiment, the movable member 732 may comprise a shaft extending through the motor 736, where the shaft can be moved by the motor in the directions of the shaft's longitudinal axis. The motor 736 may comprise a stepper motor or any other suitable motor for moving the movable member 732. In the embodiment shown in FIG. 16, the motor 736 may move the shaft 732, along the shaft's longitudinal axis, toward and away from the viewing window 704. Thus, the motor 736 may move the object 716 toward and away from the viewing window 704. The secondary display controller 114 may control the motor 736. The secondary display controller 114 may comprise a microcontroller and/or a microprocessor, and one or more of non-volatile memory (e.g., a ROM, EEPROM, flash memory, etc.), a volatile memory (e.g., a RAM), and an I/O circuit.

To a person looking through the viewing window 704, the object 716 will appear in front of the object 712 for a first range of positions of the object 716, and will appear to be behind object 712 for a second range of positions of the object 716. A detector 762 may be used to detect a transition position of the object 716 at which the depth of the object 716 appears to a viewer to be approximately equal to the depth of the object 712. The detector 762 may be operatively coupled to the secondary display controller 114 so that the secondary display controller 114 can detect when the object 716 is at the transition position. In one embodiment the detector 762 may comprise a switch that is normally in a first state, but can be changed to a second state by a flag 766. The flag 766 may be positioned on the shaft 732 such that the flag 766 changes the state of the switch 762 when the object 716 is at the transition position. For example, the detector 762 may comprise an optical-electrical device that changes to the second state when the flag 766 blocks light to a phototransistor. As another example, the detector 762 may comprise a switch that changes to the second state when the flag 766 makes contact with the switch.

The secondary display unit 88 may also comprise detectors 770 and 774 for detecting when the object 716 has reached a maximum front position and a maximum rear position, respectively. The detectors 770 and 774 may be operatively coupled to the secondary display controller 114 so that the secondary display controller 114 can detect when the object 716 is at the maximum front position and the maximum rear position. The detectors 770 and 774 may be of a type as described above with reference to the detector 762. For example, the detector 770 may be a switch normally in a first state, and a flag 778 may be positioned on the shaft 732 such that the flag 778 changes the state of the switch 770 to a second state when the object 716 is at the maximum front position. Similarly, the detector 774 may be a switch normally in a first state, and a flag 782 may be positioned on the shaft 732 such that the flag 782 changes the state of the switch 774 to a second state when the object 716 is at the maximum rear position.

In some embodiments, one or more of detectors 762, 770, and 774, and one or more of flags 766, 778, and 782 may be omitted. For example, the position of the object 716 may be determined by the secondary display controller 114 based on an initial position of the shaft 732, and based on what control signals have been applied to the motor 736. Each of flags 766, 778, and 782 may comprise a component coupled to the shaft 732 suitable for blocking light to a phototransistor, changing the state of a switch upon contact with the switch, etc. One or more of the flags 766, 778, and 782 may also comprise an integrated extension of the shaft 732. Additionally, a single component coupled to, or integrated with, the shaft 732 may comprise one or more of flags 766, 778, and 782.

The object 712 may comprise a luminous object. For example, the object 712 may be illuminated by light or lights, and/or may include, or have coupled thereto, incandescent lights, LEDs, a liquid crystal display, an alphanumeric display (e.g., a seven segment display), luminescent elements, electroluminescent elements, etc. U.S. Pat. No. 6,027,115, entitled "Slot Machine Reels Having Luminescent Display Elements," issued Feb. 22, 2000, and assigned to the assignee of the present application, describes electroluminescent elements that may be included in, or coupled to, the object 712. U.S. Pat. No. 6,027,115 is hereby incorporated by reference herein in its entirety for all purposes. Similarly, the object 716 may comprise a luminous object that may be illuminated by a light or lights, and/or include any elements as described with respect to the object 712.

In some embodiments, the object 712 may be movable as well. As one example, the object 712 may be coupled to a shaft 788, which may be coupled to a motor 792. The motor 792 may spin the shaft, and thus cause the object 712 to spin. The motor 792 may comprise a stepper motor or any other suitable motor for spinning the object 712. The motor may be operatively coupled to the secondary display controller 114 and controlled by the secondary display controller 114. It is to be understood, however, that the object 712 need not be movable. Thus, in some embodiments, the shaft 788 and motor 792 may be omitted. Position detectors and flags (not shown) associated with the object 712 may be operatively coupled to the secondary display controller 114 to allow the secondary display controller 114 to detect the position of the object 712.

In operation, the secondary display controller 114 may position the object 716 at various distances from the viewing window 704. The secondary display controller 114 may continuously move the object 716 back and forth, and/or may move the object 716 to stationary positions. Similarly, the secondary display controller 114 may spin the object 712 in one or two directions. The secondary display controller 114 may continuously spin the object 712, and/or may move the object 712 to stationary positions.

Figure 17:
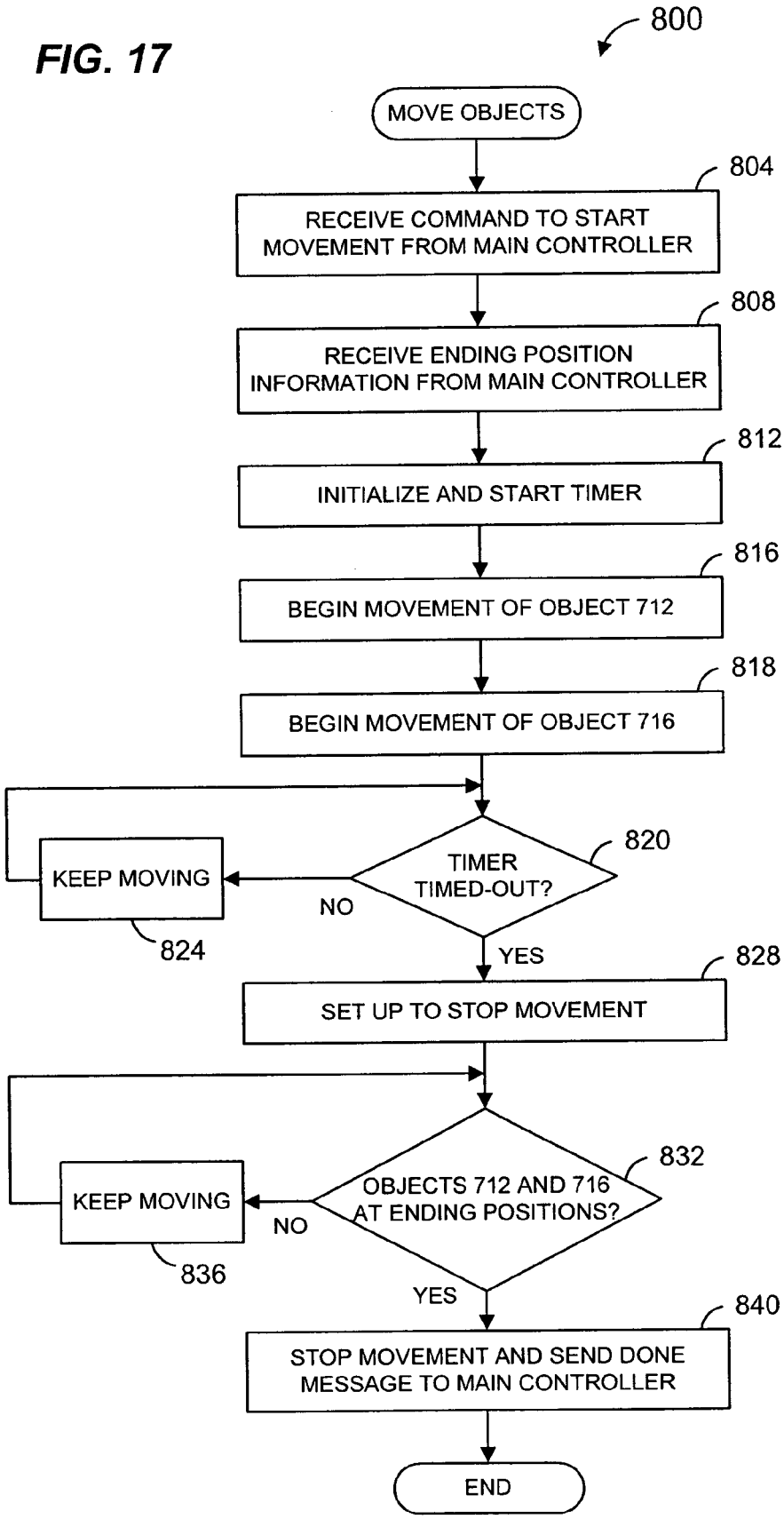
FIG. 17 is a flowchart of an embodiment of a routine that may be performed by the secondary display controller shown schematically in FIG. 16.

FIG. 17 is a flowchart of an operating routine 800 that may be stored in the memory of the secondary display controller 114. The flow of FIG. 17 will be described with reference to FIGS. 3 and 16. At block 804, the secondary display controller 114 may receive a message from the main controller 100 indicating that objects 712 and 716 are to start moving. At block 808, the secondary display controller 114 may receive from the main controller 100 an indication or indications of the positions at which the objects 712 and 716 should be stopped. At block 812, the secondary display controller 114 may initialize and start a timer. The timer may indicate a time the objects 712 and 716 should move prior to stopping them at the positions indicated at block 808.

At block 816, the secondary display controller 114 may cause the object 712 to start moving. For example, the secondary display controller 114 may control the motor 792 to start the object 712 spinning at a particular spin rate. At block 818, the secondary display controller 114 may cause the object 716 to start moving. For example, the secondary display controller 114 may control the motor 736 to cause the object 716 to move back and forth between the maximum front position and the maximum rear position as indicated by the sensors 770 and 774.

At block 820, it may be determined whether the timer started at block 812 has timed-out. If the timer has not timed-out, the flow may proceed to block 824. At block 824, the secondary display controller 114 continues to cause the objects 712 and 716 to move. If the timer has timed-out, the flow may proceed to block 828. At block 828, the secondary display controller 114 may set up to stop the movement of the objects 712 and 716. In one embodiment, the secondary display controller 114 sets up so that the objects 712 and 716 can be stopped at the respective ending positions indicated at block 808 approximately simultaneously. The set up may include, for example, progressively slowing down the movement of the object 712 and/or the object 716, performing calculations based on the current positions of the object 712 and/or the object 716 such that the objects 712 and 716 can be stopped at the respective ending positions indicated at block 808 approximately simultaneously, etc.

At block 832, it may be determined if the object 712 is at its respective ending position, and if the object 716 is at its respective ending position, as indicated at block 808. If the objects 712 and 716 are not at their respective stopping positions, the flow may proceed to block 836. At block 836, the secondary display controller 114 may keep the object 712 moving if it is not at its ending position, and may keep the object 716 moving if it is not at its ending position. For example, the secondary display controller 114 may attempt to stop the movement of objects 712 and 716 at their respective ending positions approximately simultaneously. For example, secondary display controller 114 may attempt to stop the movement such that it would appear to a person viewing the movement through the viewing window 704 that the objects 712 and 716 stopped at least approximately simultaneously. For instance, the secondary display controller 114 may attempt to stop the movement of the objects 712 and 716 within 3 seconds, 2 seconds, 1 second, 0.5 second, etc. of each other.

At block 840, the secondary display controller 114 may stop movement of the object 712 at its ending position and the object 716 at its ending position. Additionally, the secondary display controller 114 may send a message to the main controller 100 that indicates the secondary display controller 114 has stopped the objects 712 and 716 at their respective ending positions.

Referring now to FIG. 16, in one embodiment the secondary display unit 88 may be used to convey information (e.g., bonus information or the like) to a player of the gaming unit 20. The object 716 may include or be coupled to a numeric display visible through the viewing window 704. The numeric display of the object 716 may be operatively coupled to the secondary display controller 114, and the secondary display controller 114 may control the numeric display. It is to be understood that in some embodiments a display capable of displaying letters or other symbols, in addition to numbers, may also be utilized.

Figure 18:
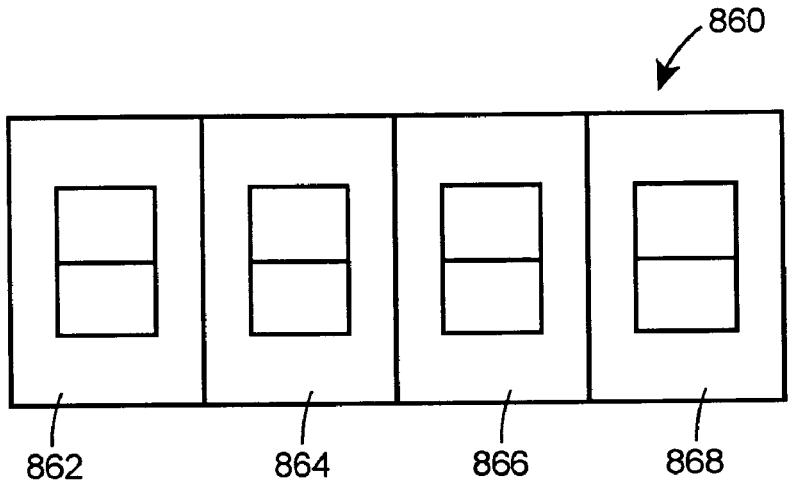
FIG. 18 is an illustration of one embodiment of a numeric display that may be included in the secondary display unit.

FIG. 18 illustrates one embodiment of a numeric display 860 that the object 716 may include or to which the object 716 may be coupled. The numeric display 860 may include one or more sections 862, 864, 866, and 868, each capable of displaying a digit. Although four sections 862, 864, 866, and 868 are illustrated in FIG. 18, more or less sections may be used in other embodiments. Additionally, although each section 862, 864, 866, and 868 is of the same type in FIG. 18, each section may be the same or different than other sections. For example, some sections may be capable of displaying only numbers, whereas other sections of displaying numbers, letters, and symbols.

The numeric display 860 may be used to convey bonus information to the player. Referring to FIG. 3, the main controller 100 may determine that a bonus has occurred, and may provide the secondary display controller 114 with bonus information that is to be presented to the player. For example, the secondary display controller 114 may control the numeric display 860 to display a number indicative of a bonus amount (e.g., a monetary value, a multiplier value, etc.).

Referring again to FIG. 16, the position of the object 716 may be used to convey bonus information to the player. The bonus information conveyed via the position of the object 716 may be the same as or different than information displayed on the numeric display 860. In one embodiment, the secondary display controller 114 may cause the object 716 to continuously move toward and away from the viewing window 704, and then stop at a stopped position. The stopped position of the object 716 may be indicative of a bonus amount. For example, for larger bonus values, the object 716 may be stopped in a position such that it appears in front of the object 712 as viewed through the viewing window 704. For smaller bonus values, the object 716 may be stopped in a position such that it appears in back of the object 712. The position of the object need not convey bonus information. For instance, in other embodiments, the object 716 may be stopped in a same position no matter what bonus has been determined by the main controller 100. In other embodiments, the object 716 may be stopped in a position that is randomly or pseudo-randomly determined by the secondary display controller 114.

Figure 19:
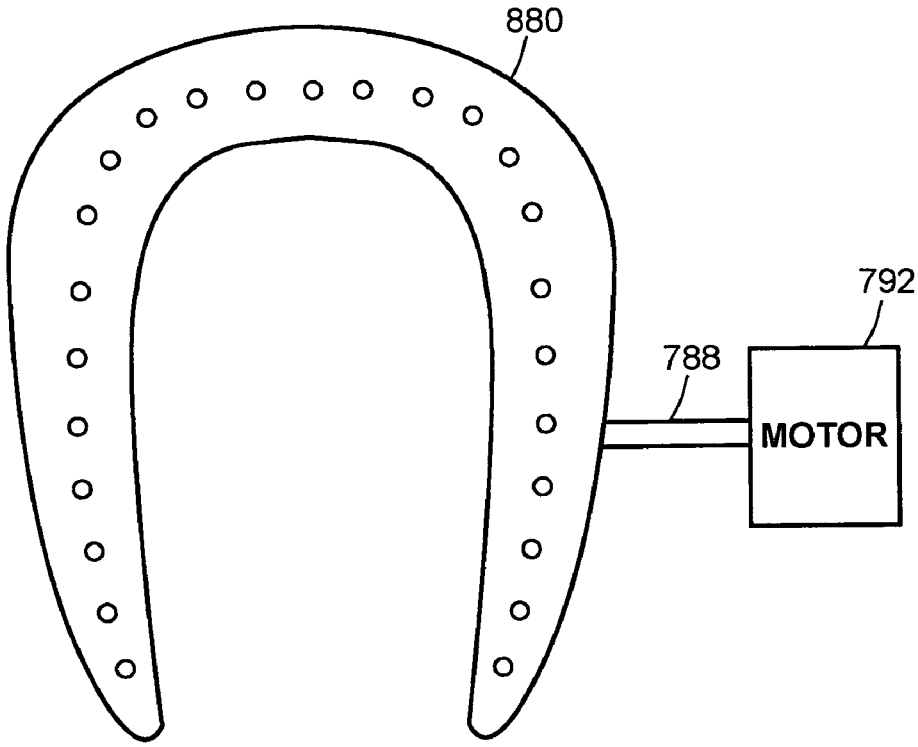
FIG. 19 is a block diagram of one embodiment of a moveable object and associated components that may be included in the secondary display unit.

The object 712 may also be used to convey bonus information. The bonus information conveyed via the object 712 may be the same as or different than information conveyed via the object 716. FIG. 19 illustrates one embodiment in which the object 712 may include a shape or depiction of a horseshoe 880. The horseshoe 880, the shaft 788, and the motor 792 may be positioned and coupled such that, as seen through the viewing window 704, the horseshoe 880 faces the viewer and appears to spin open-end over closed-end as the motor 792 spins the shaft 788. In other embodiments, the horseshoe 880 may be positioned differently and/or may spin on a different axis, or may be made to move in additional ways, such as toward and away from the mirror 708 in a manner similar to that of the object 716.

In one embodiment, the secondary display controller 114 may cause the horseshoe 880 to continuously spin, and then slow to a stopped position. The stopped position of the horseshoe 880 may be indicative of a bonus amount. Traditionally, a horseshoe positioned such that its open-end faces up is considered "good luck." Thus, in one example, for larger bonus values, the horseshoe 880 may be stopped in a position such that, as seen through the viewing window 704, its open end faces up. For smaller bonus values, the horseshoe 880 may be stopped in a position such that, through the viewing window 704, its open end faces down. The position of the horseshoe 880 need not convey bonus information. For instance, in other embodiments, the horseshoe 880 may be stopped in a same position no matter what bonus has been determined by the main controller 100. In other embodiments, the horseshoe 880 may be stopped in a position that is randomly or pseudo-randomly determined by the secondary display controller 114.

In one embodiment, first and second sides of the horseshoe 880 may have a different appearance (e.g., different colors, different illumination, different indicia, etc.). The side of the horseshoe 880 viewable from the viewing window 704 may be indicative of the bonus value. For example, the first and second sides may be colored silver and gold, respectively, and the gold side is viewable from the viewing window 704 may indicate a higher bonus than if the silver side is viewable from the viewing window 704. In one embodiment, the gold side may be viewable when the open-end of the horseshoe faces up.

Figure 20:
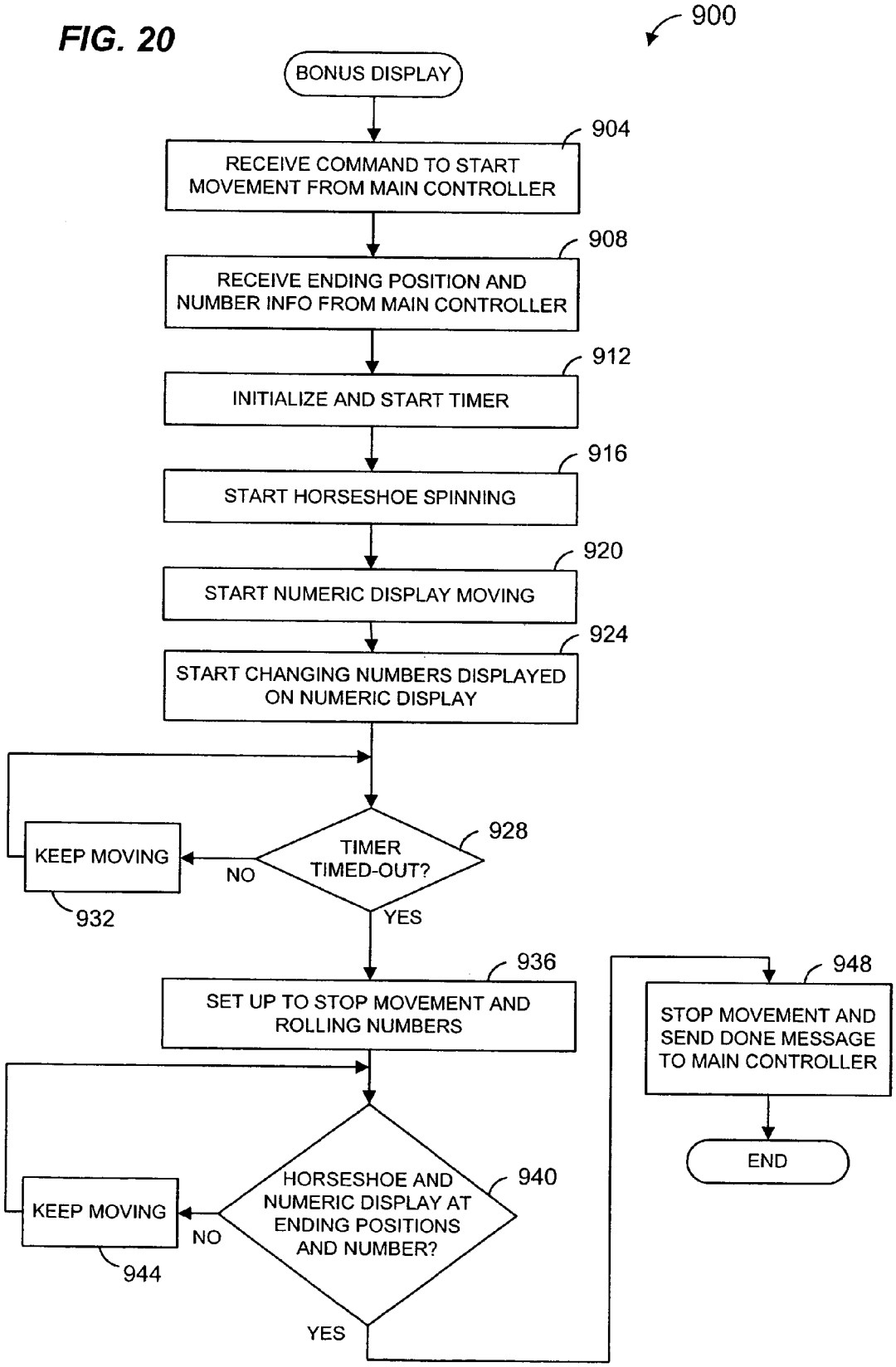
FIG. 20 is a flowchart of an embodiment of another routine that may be performed by the secondary display controller.

FIG. 20 is a flowchart of an operating routine 900 that may be stored in the memory of the secondary display controller 114. The flow of FIG. 20 will be described with reference to FIGS. 3 and 16-19. At block 904, the secondary display controller 114 may receive a message from the main controller 100 indicating that the player is to be awarded a bonus. At block 908, the secondary display controller 114 may receive from the main controller 100 an indication or indications of the positions at which the numeric display 860 and the horseshoe 880 should be stopped. Additionally, the secondary display controller 114 may receive from the main controller 100 an indication or indications of a number to be displayed on the numeric display 860. At block 912, the secondary display controller 114 may initialize and start a timer. The timer may indicate an approximate time during which the numeric display 860 and the horseshoe 880 should move, and during which the numbers on the numeric display should continuously change.

At block 916, the secondary display controller 114 may cause the horseshoe 880 to start spinning. For example, the secondary display controller 114 may control the motor 792 to start the horseshoe 880 spinning at a particular spin rate. At block 920, the secondary display controller 114 may cause the numeric display 860 to start moving. For example, the secondary display controller 114 may control the motor 736 to cause the numeric display 860 to move back and forth between the maximum front position and the maximum rear position as indicated by the sensors 770 and 774.

At block 924, the secondary display controller 114 may cause the numbers on the numeric display 860 to start changing. For example, the secondary display controller 114 may cause different numbers to be displayed on the numeric display 860 in rapid succession. The number displayed on the numeric display 860 may change, for example, approximately every 0.1 second, 0.5 second, 1 second, 2 seconds, 3 seconds, etc. The numbers may be changed at equal or different intervals. In some embodiments, the displayed numbers may be randomly or pseudo-randomly generated by the secondary display controller 114. In other embodiments, the secondary display controller 114 may alternately display numbers from a list of numbers stored in a memory.

At block 928, it may be determined whether the timer started at block 912 has timed-out. If the timer has not timed-out, the flow may proceed to block 932. At block 932, the secondary display controller 114 may continue to cause the numeric display 860 and the horseshoe 880 to move, and to cause different numbers to be displayed on the numeric display 860. If the timer has timed-out, the flow may proceed to block 936. At block 936, the secondary display controller 114 may set up to stop the movement of the numeric display 860 and the horseshoe 880, and to stop changing the numbers on the numeric display 860.

In one embodiment, the secondary display controller 114 sets up so that the numeric display 860 can be stopped at its ending position, the horseshoe can be stopped at its ending position, and the numbers displayed on the numeric display 860 can be stopped at the ending number as indicated at block 908, all approximately simultaneously. The set up may include, for example, progressively slowing down the movement of the numeric display 860 and/or the horseshoe 880. The set up may include progressively slowing down the rate at which different numbers are displayed on the numeric display 860. In one embodiment, the set up may include determining a final set of numbers to display on the numeric display 860. The set up may also include performing calculations based on the current positions of the numeric display 860 and the horseshoe 880 so that the movement of the numeric display 860 and the horseshoe 880 can be made to stop at their ending positions approximately simultaneously.

At block 940, it may be determined if the numeric display 860 is at its respective ending position, if the horseshoe 880 is at its respective ending position, and if the number displayed on the numeric display 860 is the ending number, as indicated at block 808. The ending position of the numeric display 860 may be, for example, the maximum front position, the maximum rear position, just in front of the transition position, just to the rear of the transition position, etc. The ending position of the horseshoe 880 may be, for example, its open end facing up or its open end facing down. Other ending positions of the numeric display 860 and the horseshoe 880 may be utilized as well.

If the numeric display 860 and the horseshoe 880 are not at their respective stopping positions, and if the displayed 944 is not the ending number, the flow may proceed to block 944. At block 944, the secondary display controller 114 may keep the numeric display 860 moving if it is not at its ending position. Also, the secondary display controller 114 may keep the horseshoe 880 moving if it is not at its ending position. Additionally, the secondary display controller 114 may display a different number on the numeric display 860 moving if it is not currently displaying the ending number. For example, the secondary display controller 114 may attempt to stop the movement and the changing displayed numbers such that it would appear to a person looking through the viewing window 704 that the movement of the numeric display 860 and the horseshoe 880, and the changing of the displayed numbers stopped at least approximately simultaneously. For instance, the secondary display controller 114 may attempt to stop the movement of the numeric display 860 and the horseshoe 880, and the changing of the displayed numbers, within 3 seconds, 2 seconds, 1 second, 0.5 second, etc. of each other.

At block 948, the secondary display controller 114 may stop movement of the numeric display 860 at its ending position, may stop movement of the horseshoe 880 at its ending position, and may display the ending number on the numeric display 860. Additionally, the secondary display controller 114 may send a message to the main controller 100 that indicates the secondary display controller 114 has stopped the numeric display 860 and the horseshoe 880 at their respective ending positions, and has displayed the ending number on the numeric display 860.

Referring again to FIG. 16, the object 712 may include or depict a shape or shapes other than a horseshoe, such as a number "7", a four-leaf clover, a crystal ball, etc. Additionally, rather than, or in addition to, spinning the object 712, in other embodiments it may be moved in other ways such as moving it toward and away from the mirror 708 in a manner similar to that of the movement of the object 716. In still other embodiments, the object 712 may remain stationary. Similarly, the object 716 may be made to move in additional ways such as moving in directions other than toward and away from the viewing window 704, spinning, etc.

Figure 21:
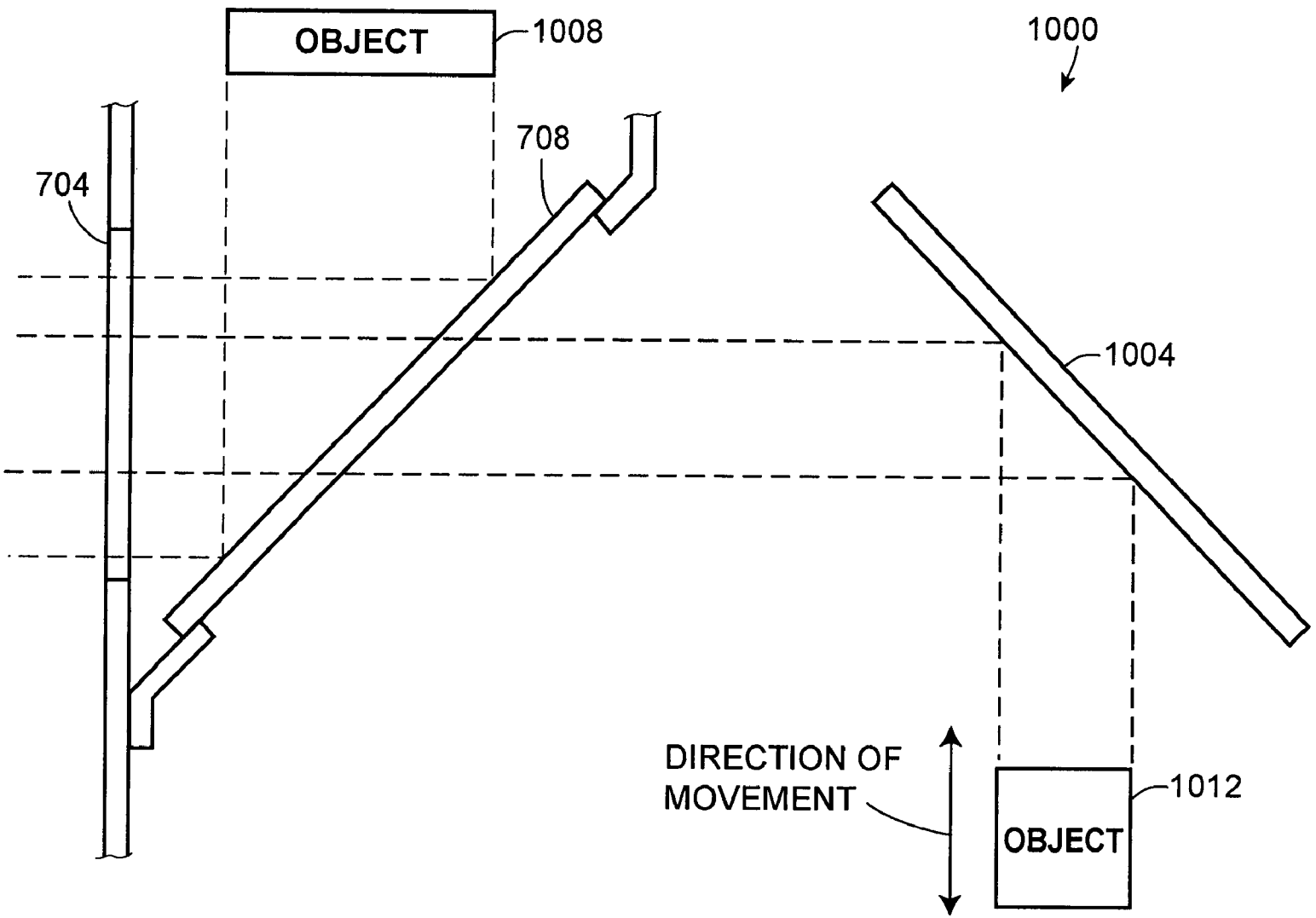
FIG. 21 is a block diagram of another embodiment of a secondary display unit.

Additionally, the object 716 need not be directly viewable from the viewing window 704. FIG. 21 illustrates another embodiment of a secondary display unit. In this embodiment, a secondary display unit 1000 includes a mirror 1004 positioned such that an image of an object 1012 is viewable through the viewing window 704. The object 1012 is moveable toward and away from the mirror 1004 as indicated by the arrow labeled "Direction of Movement." This may cause the depth of the object 1012, as viewed through the viewing window 104 to appear to change as compared to the depth of an object 1008.

Referring again to FIG. 16, the object 712 need not be directly next to the mirror 708. For example, the image of the object 712 may be reflected off of one or more other mirrors (not shown) prior to reflecting off the mirror 708. Referring to FIG. 21, the image of the object 1012 may be reflected off of one or more other mirrors before being reflected off mirror 1004.

Figure 22:
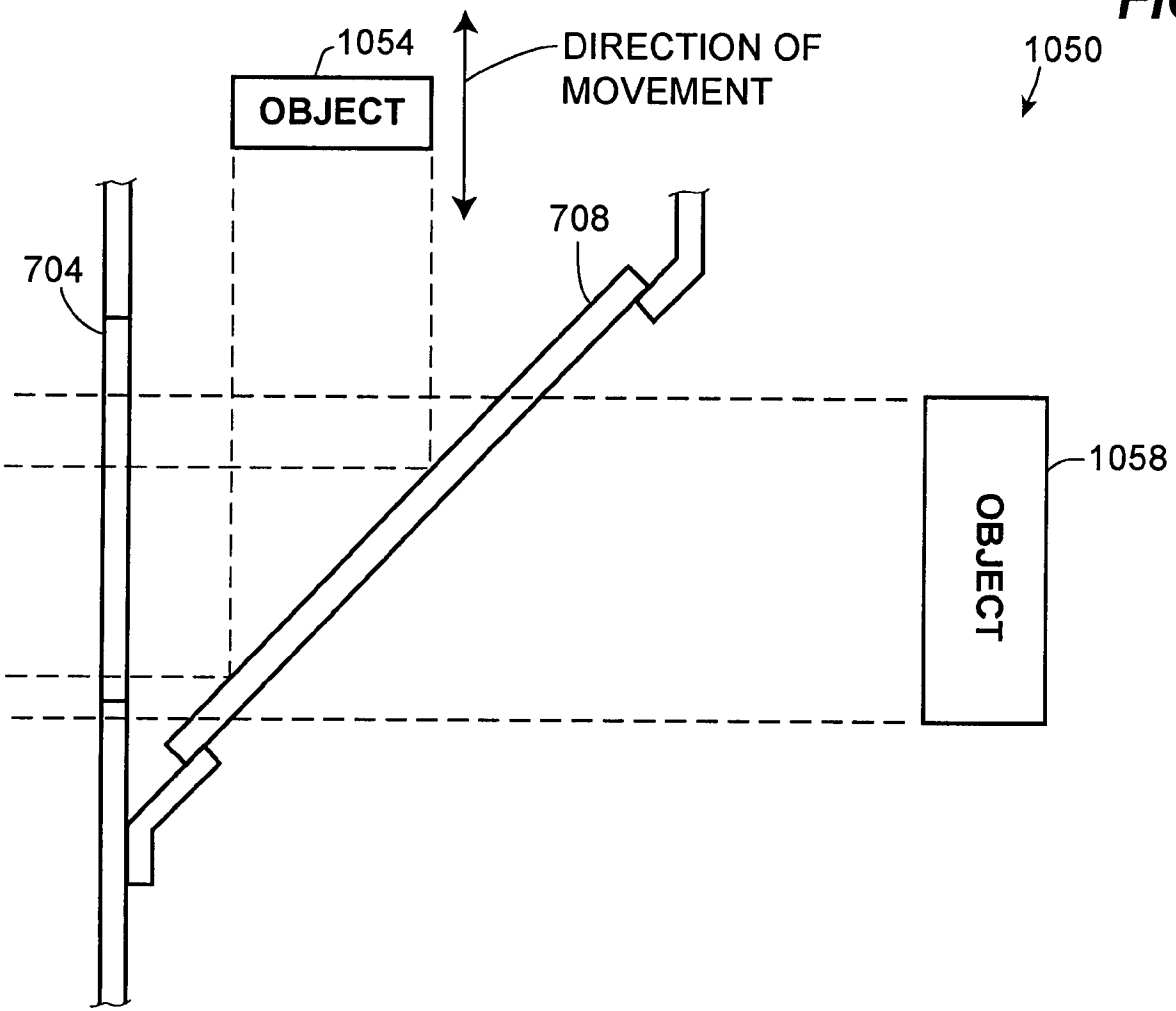
FIG. 22 is a block diagram of yet another embodiment of a secondary display unit.

FIG. 22 illustrates another embodiment of a secondary, display unit. In this embodiment, a secondary display unit 1050 is configured to provide an image of an object 1054 and an image of an object 1058 through the viewing window 704. In this embodiment, the object 1054 is moveable toward and away from the mirror 708 as indicated by the arrow labeled "Direction of Movement." This may cause the depth of the object 1054, as viewed through the viewing window 104 to appear to change as compared to the depth of an object 1058.

In the embodiments described with reference to FIGS. 16, 21, and 22, the mirror 708 has been described as at approximately a 45 degree angle with the viewing window 704. In other embodiments, however, the mirror 708 may be positioned at a variety of angles with the viewing window. In general, the mirror 708 and objects 712 and 716 should be positioned such that they are viewable through the viewing window 704.

Additionally, an example of the mirror 708 has been described as transmitting approximately 50% light and reflecting approximately 50% light. Other transmission/reflection ratios, however, may also be utilized. In general, a transmission/reflection ratio for the mirror 708, and the brightness of the objects 712 and 716 themselves, may be selected or adjusted so that the objects 712 and 716, as viewed through the viewing window 704, each have a desired brightness. For example, if it is desired that the object 716 appear brighter than the object 712, then a mirror 708 that reflects 40% and transmits 60% may be appropriate. Alternatively, a 50% mirror may be utilized, but the brightness of the objects 712 and 716 may be adjusted so that the object 712 appears brighter than object 716 in the viewing window 704. Similarly, if it desired that the objects 712 and 716 have approximately the same brightness as seen through the viewing window, and if the mirror 708 reflects 40% and transmits 60%, the brightness of the object 712 may be made brighter than that of the object 716.

In the above description, various methods have been described with reference to flow diagrams. It will be apparent to one of ordinary skill in the art that each of these methods may be implemented, in whole or in part, by software, hardware, and/or firmware. If implemented, in whole or in part, by software, the software may be stored on a tangible medium such as a CD-ROM, a floppy disk, a hard drive, a digital versatile disk (DVD), a ROM, an EEPROM, a flash memory, etc. Further, although the examples described above were described with reference to various flow diagrams, one of ordinary skill in the art will appreciate that many other methods may alternatively be used. For example, the order of execution of the blocks may be changed, and/or some or all of the blocks may be changed, eliminated, or combined.

What is claimed is:

1. A gaming apparatus, comprising:

a primary display unit;

a value input device;

a first controller operatively coupled to the primary display unit and the value input device, the first controller comprising a first microprocessor and a first memory operatively coupled to the first microprocessor, the first controller being configured to receive wager data from the value input device, the wager data indicative of a wager submitted by a player;

the first controller being configured to cause the primary display unit to display an outcome of a game, the first controller being configured to determine a value payout associated with the outcome of the game;

the gaming apparatus further comprising a secondary display unit separate from the primary display unit, the secondary display unit comprising:

a viewing window;

a first object coupled to a movable member;

a second object;

a semitransparent mirror positioned posterior to the viewing window to reflect an image of one of the first object and the second object and to transmit an image of the other of the first object and the second object, wherein the image of the first object and the image of the second object are viewable through the viewing window;

a first motor coupled to the movable member to move the first object such that a depth of the image of the first object changes relative to a depth of the image of the second object as viewed through the viewing window.

2. A gaming apparatus according to claim 1, wherein the secondary display unit further comprises a second controller separate from the first controller, the second controller operatively coupled to the first motor, the second controller configured to cause the first motor to move the first object such that the depth of the image of the first object changes relative to the depth of the image of the second object.

3. A gaming apparatus according to claim 2, wherein the second controller is configured to cause the first motor to repeatedly move the first object during a time period.

4. A gaming apparatus according to claim 3, wherein the second controller is configured to cause the first motor to stop the first object at an ending position after the time period.

5. A gaming apparatus according to claim 4, wherein at least one of the first object and the second object comprises a numeric display, the numeric display capable of displaying at least numbers, wherein the numeric display is operatively coupled to the second controller, wherein numbers displayed by the numeric display are viewable through the viewing window;

wherein the second controller is configured to cause the numeric display to display changing numbers during the time period.

6. A gaming apparatus according to claim 5, wherein the second controller is operatively coupled to the first controller;

wherein the first controller is configured to determine if the game is in bonus;

wherein the first controller is configured to transmit bonus information to the second controller if the game is in bonus;

wherein the second controller is configured to cause the first motor to move the first object during the time period in response to the bonus information;

wherein the second controller is configured to determine an ending number based on the bonus information;

wherein the second controller is configured to cause the numeric display to display the ending number on the display after the time period.

7. A gaming apparatus according to claim 6, wherein the bonus information comprises the ending number.

8. A gaming apparatus according to claim 6, wherein the second controller is configured to cause the numeric display to change to the ending number and to cause the first motor to stop the first object at the ending position at substantially the same time.

9. A gaming apparatus according to claim 2, wherein the secondary display unit further comprises a second motor coupled to the second object, and operatively coupled to the second controller;

wherein the second controller is configured to cause the second motor to move the second object.

10. A gaming apparatus according to claim 9, wherein the second motor is coupled to the second object to cause the second object to spin.

11. A gaming apparatus according to claim 9, wherein the first object comprises a numeric display, the numeric display capable of displaying at least numbers, wherein the numeric display is operatively coupled to the second controller, wherein numbers displayed by the display are viewable through the viewing window;

wherein the second controller is operatively coupled to the first controller;

wherein the first controller is configured to determine if the game is in bonus;

wherein the first controller is configured to transmit bonus information to the second controller if the game is in bonus;

wherein the second controller is configured to cause the first motor to repeatedly move the first object during a time period in response to the bonus information;

wherein the second controller is configured to cause the numeric display to display changing numbers during the time period;

wherein the second controller is configured to cause the second motor to move the second object during the time period;

wherein the second controller is configured to determine a first ending position, a second ending position, and an ending number based on the bonus information;

wherein the second controller is configured to cause the first motor to stop the first object at the first ending position after the time period;

wherein the second controller is configured to cause the numeric display to display the ending number on the display after the time period; and wherein the second controller is configured to cause the second motor to stop the second object at the second ending position after the time period.

12. A gaming apparatus according to claim 11, wherein the second controller is configured to cause the first object to stop at the first ending position, the numeric display to change to the ending number, and the second object to stop at the second ending position at substantially the same time.

13. A gaming apparatus according to claim 1, wherein the primary display unit comprises at least one mechanical reel.

14. A gaming apparatus according to claim 1, wherein the primary display unit comprises at least one video display unit.

15. A gaming method comprising:

receiving a wager from a player via a value input device;

displaying an outcome of a game via a primary display unit;

determining a value payout associated with the outcome of the game;

displaying an image of a first object and an image of a second object via a secondary display unit, the secondary display unit having a viewing window, wherein the image of the first object and the image of the second object appear superimposed as viewed from the viewing window;

determining a condition of the game;

in response to the condition, causing the first object to repeatedly move during a period of time, such that the depth of the image of the first object relative to a depth of the image of the second object changes as viewed from the viewing window during the period of time; and after the period of time, causing the first object to stop at a first ending position.

16. A gaming method according to claim 15, further comprising determining the first ending position.

17. A gaming method according to claim 16, wherein determining the first ending position comprises determining the first ending position based on the condition.

18. A gaming method according to claim 15, wherein the first object includes a numeric display capable of displaying at least numbers, wherein the numeric display is viewable from the viewing window, the method further comprising:

in response to the condition, causing the numeric display to repeatedly display different numbers during the period of time;

after the period of time, causing the numeric display to display an ending number.

19. A gaming method according to claim 18, further comprising determining the ending number.

20. A gaming method according to claim 19, wherein determining the ending number comprises determining the ending number based on the condition.

21. A gaming method according to claim 18, further comprising:

in response to the condition, causing the second object to repeatedly move during the period of time; and after the period of time, causing the second object to stop at a second ending position.

22. A gaming method according to claim 21, further comprising determining the second ending position.

23. A gaming method according to claim 22, wherein determining the second ending position comprises determining the second ending position based on the condition.

24. A gaming method according to claim 21, further comprising:

causing the first object to stop at the first ending position, causing the numeric display to display the ending number, and causing the second object to stop at the second ending position at substantially the same time.

25. A gaming apparatus, comprising:

a primary display unit;

a value input device;

a first controller operatively coupled to the primary display unit and the value input device, the first controller comprising a first microprocessor and a first memory operatively coupled to the first microprocessor, the first controller being configured to receive wager data from the value input device, the wager data indicative of a wager submitted by a player, the first controller being configured to cause the primary display unit to display an outcome of a game, the first controller being configured to determine if the game is in bonus, the first controller being configured to transmit bonus information to a second controller if the game is in bonus, the first controller being configured to determine a value payout associated with the outcome of the game, the gaming apparatus further comprising a secondary display unit separate from the primary display unit, the secondary display unit comprising:

a viewing window;

a first object coupled to a movable member, the first object including a numeric display, the numeric display capable of displaying at least numbers, wherein numbers displayed by the numeric display are viewable through the viewing window;

a second object;

a semitransparent mirror positioned posterior to the viewing window to reflect an image of one of the first object and the second object and to transmit an image of the other of the first object and the second object, wherein the image of the first object and the image of the second object are viewable through the viewing window;

a first motor coupled to the movable member to move the first object such that a depth of the image of the first object changes relative to a depth of the image of the second object as viewed through the viewing window;

a second controller separate from the first controller, the second controller operatively coupled to the first motor and to the numeric display, the second controller being configured to, in response to the bonus information received from the first controller, cause the first motor to repeatedly move the first object during a time period such that the depth of the image of the first object changes relative to the depth of the image of the second object, the second controller being configured to, in response to the bonus information received from the first controller, cause the numeric display to display changing numbers during the time period, the second controller being configured to cause the first motor to stop the first object at an ending position after the time period, and the second controller being configured to cause the numeric display to display an ending number after the time period.

26. A gaming method according to claim 15, wherein the condition is a bonus condition.

* * * * *